US011011009B2

(12) United States Patent
Felique

(10) Patent No.: US 11,011,009 B2
(45) Date of Patent: May 18, 2021

(54) METHOD AND APPARATUS FOR CONTROLLING AND MONITORING A VENDING MACHINE

(76) Inventor: Pascal Felique, Linkoeping (SE)

( * ) Notice: Subject to any disclaimer, the term of this patent is extended or adjusted under 35 U.S.C. 154(b) by 0 days.

(21) Appl. No.: 13/637,314

(22) PCT Filed: Mar. 29, 2010

(86) PCT No.: PCT/BE2010/000026
§ 371 (c)(1),
(2), (4) Date: Sep. 25, 2012

(87) PCT Pub. No.: WO2011/120104
PCT Pub. Date: Oct. 6, 2011

(65) Prior Publication Data

US 2013/0013107 A1 Jan. 10, 2013

(51) Int. Cl.
*G07F 9/00* (2006.01)

(52) U.S. Cl.
CPC ..... *G07F 9/00* (2013.01); *G07F 9/006* (2013.01)

(58) Field of Classification Search
CPC ..... G07F 9/006; G07F 9/026
USPC ..... 700/236, 241, 244
See application file for complete search history.

(56) References Cited

U.S. PATENT DOCUMENTS 4,485,467 A * 11/1984 Miles et al. ..... 370/220
6,462,644 B1 * 10/2002 Howell et al. ..... 700/239
6,839,610 B2 * 1/2005 Carstens et al. ..... 700/236
6,854,642 B2 * 2/2005 Metcalf et al. ..... 235/375
7,053,773 B2 * 5/2006 McGarry et al. ..... 340/568.1
7,209,874 B2 * 4/2007 Salmonsen ..... H04L 12/283 703/23
7,428,987 B2 9/2008 Ota et al.
(Continued)

OTHER PUBLICATIONS

Subject matter: Microcontroller with on-chip debug features Author: Atmel Corporation Title: Atmel ATmega640/V-1280/V-1281/V-2560/V-2561/V DATASHEET Date: Feb. 2014 pp. 289 Source: https://ww1.microchip.com/downloads/en/devicedoc/atmel-2549-8-bit-avr-microcontroller-atmega640-1280-1281-2560-2561_datesheet.pdf Publisher: Atmel Corporation Country: USA.
(Continued)

*Primary Examiner* — Timothy R Waggoner

(57) ABSTRACT

An apparatus to control and/or monitor a vending machine. The apparatus controls and/or monitors the microcontroller on the vending machine controller board in the vending machine, to control and/or monitor status information, configuration data, one or more events, and/or one or more activities, in the vending machine. The apparatus can be integrated and/or used with a vending machine, without replacing the vending machine controller board and without changing the vending software program in the vending machine. The apparatus implements and/or uses a hardware abstraction layer (HAL) and provides a software application programming interface (API) library to the vending machine. The software API library is used by a software application to control and/or monitor the vending machine. Software applications can be developed for existing and/or new vending machines, without knowing the technical hardware and/or software details of the vending machine. The software application can control and/or monitor different vending machine brands and/or types.

60 Claims, 6 Drawing Sheets

(56) References Cited

U.S. PATENT DOCUMENTS

| | | | | |
|---|---|---|---|---|
| 7,630,939 | B1 * | 12/2009 | Kolls | 705/43 |
| 7,739,181 | B2 * | 6/2010 | Breitenbach | G07F 9/026 705/37 |
| 7,778,600 | B2 * | 8/2010 | Godwin et al. | 455/41.1 |
| 7,822,503 | B2 * | 10/2010 | Merwarth et al. | 700/236 |
| 8,103,380 | B2 | 1/2012 | Cheng et al. | |
| 8,140,185 | B2 * | 3/2012 | Simmons et al. | 700/241 |
| 8,197,779 | B2 * | 6/2012 | Lee et al. | 423/239.1 |
| 8,596,529 | B1 * | 12/2013 | Kolls | G06Q 30/06 705/40 |
| 8,797,737 | B2 | 8/2014 | Kang et al. | |

OTHER PUBLICATIONS

Subject matter: Microcontroller with on-chip debug features Author: Atmel Corporation Title: Atmel ATtiny1634 Datasheet Date: Feb. 2014 pp. 201 Source: http://ww1.microchip.com/downloads/en/DeviceDoc/Atmel-8303-8-bit-AVR-Microcontroller-tinyAVR-ATtiny1634_Datasheet.pdf Publisher:. Atmel Corporation Country: USA.

Subject matter: Microcontroller with software debug program Author: Paul Stoffregen Title: Introductions to PAULMON2 monitor program Date: Feb. 2005 pp. intro.html Source: https://www.pjrc.com/tech/8051/pm2_docs/intro.html Publisher. pjrc.com, LLC. Country: USA.

Subject matter: Microcontroller with software debug program Author: Jesus Calvino-Fraga Title: Introduction to CMON51 monitor program Date: Feb. 2005 pp. index.htm Source: http://cmon51.sourceforge.net/ Publisher: Jesus Calvin-Fraga Country: Canada.

Subject matter: Microcontroller with software debug program Author: John Hartman Title: NoICE is a debugger for microprocessors Date: Feb. 1996 pp. index.html Source: https://www.noicedebugger.com/index.html Publisher: John Hartman Country: USA.

* cited by examiner

METHOD AND APPARATUS FOR CONTROLLING AND MONITORING A VENDING MACHINE

CROSS REFERENCE TO RELATED APPLICATIONS

This patent application claims benefit to International Application No. PCT/BE2010/000026 filed on Mar. 29, 2010.

BACKGROUND OF THE INVENTION

Vending machines are well known in the art. Generally they serve the purpose of selling beverages and snacks but can also be used to sell other items such as newspapers, etc. Most vending machines are operated by vending companies that offer a wide variety of services, however, companies producing beverages, also own and service a great number of vending machines. Item selection in a vending machine is performed by selecting the item using a user interface of the vending machine. The user interface of the vending machine generally contains push buttons for the user to choose the desired item. Most vending machines include a system for receiving payment for the particular article and a system for dispensing the article from the dispensing department to the merchandise removal area. When the consumer makes an item selection after payment has been received, the machine releases the product such that it falls in an open compartment at the bottom, or into a cup. The product may also become available by the unlocking of a door, drawer, turning of a knob, etc. Sometimes the product is not just released but prepared.

Generally, a central processor on the Vending Machine Controller (VMC) board in the vending machine is responsible for the control of and activities within the vending machine which include, but are not limited to: 1) communication with the payment system to keep track of the inserted amount of credit, 2) monitor button presses on the selection panel to check if the consumer selects an item, 3) control motor relay in the vending machine to release a product through the dispenser unit, 4) monitor drop sensor to check if product is sold-out, 5) monitor temperature sensor and control temperature of items within the vending machine by means of the cooling system. The VMC board contains a microcontroller, which is typically an Intel 8051 derived microcontroller, or a Motorola 68HC11 derived microcontroller, or other microcontroller series.

People skilled in the art are familiar with the different payment systems available within the vending industry. Vending machines that accept payment contain a payment system like a currency detector or a cashless device. Typically coin acceptors/changers, bill validators/recyclers and cashless devices are connected to the Vending Machine Controller in the vending machine by means of a serial interface, such as MDB/ICP, Executive, VCCS, BDV, Micromech, Simplex III, HII, etc. The most widely accepted serial interface within the vending industry is the MDB standard defined by NAMA (National Automatic Merchandising Association). The MDB/ICP protocol (Multi-Drop Bus/Internal Communication Protocol) is a serial bus interface for electronically controlled vending machines. It standardizes vending machines that employ electronic controls so that all vending and peripheral equipment communicate identically. The MDB/ICP protocol is available from NAMA (www.vending.org).

People skilled in the art are familiar with the features and advantages of telemetry within the vending industry. The fact that vending equipment tends to be strategically placed in disparate locations, presents a challenge to efficient replenishment, sales analyses, malfunction notification and comprehensive audit reporting. Telemetry offers a central management system for remotely managing (monitoring and controlling) all vending machines in operation. Aggregating machine-level data enables remote review of transactions and inventory without having to have a physical presence at the machine. Generally the central management system provides a two-way, on-demand communication with the vending machines in operation. The vending machines can be connected by means of a built in PSTN or GSM/GPRS modem enabling communication over a telephone network or a different type of connection may be used, e.g. Ethernet network interface. Telemetry systems are built on the industry standard DEX/UCS interface (Data-Exchange Uniform Code Standard). The DEX/UCS specification defines a direct connect communications interface for the interchange of data between two electronic devices. The EVA-DTS standard (European Vending Association Data Transfer Standard) is based on the DEX/UCS communications standard. The vending industry adopted this standard as a means for transferring information between vending devices. The EVA-DTS standard links two electronic devices together for transferring vending audit data (snapshot of the cumulated stored information) or configuration data (test routines and machine setup). The Vending Machine Device (VMD) in the vending machine monitors the various transactions (e.g. vends, sold outs, coins and bills accepted, etc.) and assimilates the audit data. The Data Carrier (DC) interrogates or configures the Vending Machine Device using DEX/UCS. The actual data records that are transferred follow the format of the DEX/UCS Delivery/Return Base Records. Data records unique to the vending environment are found in the data dictionary of the EVA Data Transfer Standard. DEX data sets include sales mix, cash collection, product movement and malfunction alerts. The EVA-DTS standard is available from EVA, European Vending Association (www.eva.be).

People skilled in the art are familiar with the features and advantages of multimedia within the vending industry. These multimedia features (picture-, movie- and sound-elements) can include a graphical user interface to increase the attractiveness of vending machines, and can include multimedia advertising and info kiosk capabilities to convert a vending machine from a beverage/candy/other item dispenser into a media channel for effective local commercials.

People skilled in the art are familiar with energy management techniques used within the vending industry to save on energy consumption and increase the life-time of components in the vending machine. Most vending machines utilize lighting behind the front panel to light up the marquee, and draw the attention to potential customers. Cold-drink vending machines utilize cooling devices to maintain the beverages at a dispensing temperature different from the ambient temperature. The cooling devices typically include a compressor to compress a refrigerant and an evaporator to evaporate the refrigerant, as is well-known to people skilled in the art. Given that most cold-drink vending machines are located in controlled environment conditions (schools, office buildings, shopping centers, etc.), it is fairly easy to predict hours of inactivity. During non-business hours or hours of inactivity, energy can be conserved by not requiring beverages to be at optimum serving temperature and turning off lighting. During times of low use, the vending machine can be completely powered down, or the vending machine's cooling system can be controlled and switched between different operation modes, allowing the advertising lighting and controller electronics to stay on while the machine is in energy savings mode.

One prior-art solution upgrades a traditional vending machine to a modern vending machine with 1) alternative payment means (such as mobile phone payment or internet payment solution, etc.), and/or 2) real-time telemetry functionality (for remote monitoring and controlling a vending machine), and/or 3) integrated multimedia features (such as a graphical user interface, multimedia advertising and info kiosk capabilities), and/or 4) intelligent energy management (to reduce energy costs), by replacing the original VMC board with a modern VMC board which provides any, a combination of some, or all of, the above features on-board. The disadvantage of this known system is that it includes costly components and it is not suitable for additionally installing into already operating, conventional beverage vending machines, without the need to replace the entire conventional VMC board. The VMC board needs custom interfaces (e.g. connection to selection panel, connection to display panel, connection to sold-out led panel, connection to vend motors, connection to temperature probe, connection to refrigerator and evaporator, connection to drop sensor, connection to door sensor, etc.) to integrate it in different vending machine brands and types, and therefore needs to be realized in different versions and badges: this makes the VMC board and associated custom interfacing cables very expensive, as it is a custom solution produced in low quantities. Accordingly, the installation of this known system is very expensive, and it is not suitable for a cost efficient integration.

The present invention uses In-Circuit Emulation techniques, modified emulated microcontroller peripherals, an emulated switch matrix circuit or a generic processor to add additional features to the vending machine at the processor level of the VMC board.

The objects and features of the present invention will become more apparent and the invention will be best understood from the following background description on the applied technology.

People skilled in the art are familiar with microcontrollers. A microcontroller is a small computer on a single integrated circuit consisting internally of a CPU, clock, memory, I/O ports, timers, and other peripherals. Microcontrollers are designed for small or dedicated applications. The majority of microcontrollers in use today are embedded in other machinery, such as automobiles, telephones, vending machines, etc.

People skilled in the art are familiar with onboard microcontroller peripherals within a microcontroller. Single chip microcontrollers have onboard functionality performed by onboard microcontroller peripherals, which include, but are not limited to: 1) I/O ports for processing digital input and output signals, 2) UART peripheral (Universal Asynchronous Receiver/Transmitter) to receive and transmit data over a serial line, 3) A/D converter (analog-to-digital) to read sensors that produce analog signals, 4) D/A converter (digital-to-analog) to output analog signals or voltage levels, 5) I2C (Inter-Integrated Circuit) for Inter-IC communication between components which reside on the same circuit board, 6) PWM (Pulse Width Modulation) to control motors.

People skilled in the art are familiar with the function of an interrupt controller within a microcontroller. Interrupt handling on the microcontroller enables the microcontroller to respond to events at the moment they occur, regardless of what the microcontroller is doing at the time. Generally, each interrupt changes the program flow, interrupts it and after executing an interrupt routine it continues from that same point on. The interrupt controller's goal is to provide interrupt capabilities to the main processor (CPU) through a single line. When a device issues an interrupt, it is delivered to one of the interrupt controller's Interrupt Request lines (IRQ), from there the interrupt is generated in the main processor, which, in turn, checks with the interrupt controller for the source of the interrupt through a special register, which is managed by the interrupt controller. Interrupt controllers can provide interrupt-priority, interrupt-masking and other general flexibility for dealing with interrupts.

People skilled in the art are familiar with the features and advantages of FPGA (Field Programmable Gate Array) semiconductor devices. FPGAs contain programmable logic components called "logic blocks", and a hierarchy of reconfigurable interconnects that allow the logic blocks to be wired together. Logic blocks can be configured to perform complex combinational functions, or merely simple logic gates like AND and XOR. The logic blocks also include memory elements, which may be simple flip-flops or more complete blocks of memory. FPGAs are programmed using a logic circuit diagram or a source code in a hardware description language (HDL) to specify how the chip will work. They can be used to implement any logical function that an application-specific integrated circuit (ASIC) could perform, but the ability to update the functionality after shipping offers advantages for many applications. SRAM based FPGA solutions, are blank at power-up and do not perform user functions. The SRAM cells of these FPGAs have to be loaded with configuration data based on user functions from external boot memories. Non-volatile FPGA solutions store configuration data on-chip eliminating the need for external boot memory and associated long configuration times. FPGAs can be manufactured in high volume, reducing cost, since each user can configure the FPGA in a short amount to select a unique configuration to run on the standard FPGA.

People skilled in the art are familiar with the features and advantages of Soft-cores. The FPGA can be programmed with a model of a microprocessor or microcontroller (called a soft core), for example an 8051 (or derivative of 8051). The FPGA can be programmed to have the characteristics of one or more types of memory, for example RAM, ROM, PROM and EEPROM to emulate the different types of memory. A RAM array contains internal RAM and external RAM. Internal RAM provides the internal memory and working registers needed for the microcontroller. External RAM provides a data store for the microcontroller. External ROM is a code store that provides a program to the microcontroller. External ROM is actually part of the RAM array but has its memory characteristics programmed in the memory interface of the FPGA so that it functions as ROM. External PROM and external EEPROM are additional types of memory that have their memory characteristics programmed into the memory interface. As with the ROM they are actually part of the RAM array but are programmed to function as PROM and EEPROM. Being able to program memory characteristics of ROM and EEPROM into the memory interface allows the usage of one RAM array in the FPGA. The VHDL or VERILOG description can be used as the input to the FPGA design and synthesis tools available from the FPGA manufacturer, to realize the virtual microprocessor or microcontroller (generally after timing adjustments and other debugging). Thus, design and realization of a soft-core FPGA implementation for the original microprocessor or microcontroller (virtual microprocessor or microcontroller) can be readily achieved by the use of the VHDL or VERILOG description.

People skilled in the art are familiar with In-Circuit Emulators and know how they work. In-Circuit Emulators have been used for many years by software and hardware developers as a development tool to emulate the operation of complex devices such as microcontrollers and microprocessors, and permit diagnosis and debugging of hardware and software during system integration.

An In-Circuit Emulator (ICE) is a non-intrusive software debugging tool that uses external hardware to provide transparent operation of a microprocessor embedded in a target circuit. The ICE physically replaces the target processor: the original CPU is extracted from its socket and the plug of the ICE emulator cable is inserted into the socket. Some emulators come with an adapter that clips over the processor, tri-stating the device's core which is then replaced by the ICE's own CPU. The emulator microprocessor substitutes the target microprocessor during target circuit testing and execution. Emulating the processor lets the ICE do anything that the processor can do, but under the control of a programmer. While retaining the same functionality as the original microprocessor, it provides extra debugging and testing mechanisms to support designers in the development/maintenance of the hardware and software of the target systems.

A typical arrangement for in-circuit emulation includes a host computer system that is coupled to the microcontroller to be tested through a debug logic block. The host computer contains a source level debugging software program that cooperates with the debug logic block. Instructions from the host computer system are loaded to the microcontroller through the debug logic block, which monitors the performance of the microcontroller as the instructions are executed by the microcontroller. It can be used as a standard source code debugger, implementing breakpoints and watch-points. It can also be used as a non-intrusive debugging tool, being able to detect and take account of complex event occurrence. As the microcontroller steps through the execution, the debug logic block collects information about the various components of the microcontroller and feeds that information back to the host computer system. Trace information (such as time stamps, register values, data memory content, etc.) may be logged and fed back to the host computer system. The debug functionality is usually accessed via the JTAG port, however a variety of protocols and standards have been established concerning embedded processors that establish parameters for On-Chip Debug Systems:

The Joint Test Action Group standard, referred to as "JTAG", is the IEEE standard for boundary scans (IEEE 1149.1). It is a framework for standardized design-for-testability of integrated circuits for module-level testing. It allows the inputs/outputs and internal signals of the digital logic of the integrated circuit to be accessed from outside modules. The advantage is that the controllability and observability of a module containing many components is vastly improved while the input/output overhead of the module is minimized. JTAG is used for more purposes than just boundary scan testing, and is the standard interface for sending commands and performing data exchange with embedded processors these days. CPU and FPGA manufacturers allow JTAG to be used as debug port. FPGA manufacturers use the JTAG port for the configuration of the FPGA, and the JTAG signals can be used inside the FPGA core.

Another interface standard for On-Chip Debug Systems is the Nexus 5001 Standard for a Global Embedded Processor Debug Interface (IEEE-ISTO 5001). This interface standard is capable of exchanging data at a much higher bandwidth.

People skilled in the art are familiar with breakpoints and watch-points. A breakpoint is an event produced when an access to a specific program memory location takes place. A watch-point is an event produced when a value is read from or written to a specific data memory location. If a specified condition occurs then either the operation of the embedded processor is halted (typically for a breakpoint) or a message is sent to the debug tool (typically for a watch-point). The breakpoint event is signaled before the instruction pointed by the Program Counter is executed. The watch-point event is signaled after the instruction is being executed.

People skilled in the art are familiar with software breakpoints. Software breakpoints work by replacing the destination instruction in program memory by a software interrupt or similar instruction. A specific instruction op-code is allocated as a breakpoint instruction. When the CPU of the processor executes this breakpoint instruction, the CPU can enter debug mode, and return control to the debugger. Software breakpoints are popular, as they are relatively inexpensive to implement, and a large number of breakpoints can be inserted. However, software breakpoints do have a few drawbacks, which limit their usefulness. It is impossible to debug code in ROM with software breakpoints. Some instructions may depend on the mode in which they are executed, e.g. they may execute differently in debug mode than in normal mode. Other instructions, such as a branch instruction, may depend on the current program counter (PC) location as well.

People skilled in the art are familiar with hardware breakpoints. Hardware breakpoint modules do not alter the program memory, but instead halt the CPU when instructions at a particular address in the code are executed. The program is run with full clock speed (in real-time), and the processor is halted when the hardware signals a true breakpoint condition. The Breakpoint Detect Unit detects whether the processor matches the breakpoint condition by monitoring the value(s) on the address bus of the microprocessor. A comparator compares the specified address with the address going to the code ROM, as long as they are different, then the processor clock keeps running. The hardware breakpoint modules may be very costly in terms of silicon area and normally only a relatively small number of hardware breakpoint modules may be included in a singular system. Hardware breakpoints work in RAM, ROM, EPROM and Flash.

People skilled in the art are familiar with tracing and tracing buffers. The trace buffer is a high speed RAM used to capture in real time all activity that occurs at the microcontroller across a certain period of time. The host software can then examine this and show what happened before the breakpoint. Trace information can include data such as time stamps (reference clock signal), program trace (all addresses the program has executed), data trace (all addresses and data values that the microcontroller has written to and read from), evolution of some variables or parameters, register values, port values, user logic state inputs. To minimize bandwidth requirements, trace information is generally compressed by the on-chip debug interface before being emitted externally or stored on chip. By means of branch messages, the external debug tool and/or the host computer can use this program trace information to reconstruct the program flow.

People skilled in the art are familiar with event sequencers and complex events. Complex events can be used for break pointing and trace filtering. Each event is capable of comparing in real-time the address bus, data bus, and cycle type. With the use of an event sequencer any combination of events and counters may be mixed to achieve a trigger based on a predetermined sequence of events. With an optional user probe, external signals may be used to define event conditions and filter trace or stop program execution.

People skilled in the art are familiar with the advantages of dual ported high-speed RAM memory used in ICE emulators. Typically the ICE's emulation memory is high speed RAM inside of the emulator itself that maps logically in place of the system's ROM and RAM. By means of dual ported memory it is possible to read and write memory while the processor is running without impacting or intruding on the currently executing instructions. The executing CPU and the PC host can access the emulation memory at the same time.

Since the CPU has to run in real-time, a special circuitry decodes possible bus collisions and gives higher priority to the executing CPU. This feature allows instant viewing and modification of emulation memory (program and data) without stopping or slowing down the running application. Any code or external data variables may be read or written to without disturbing the running program.

People skilled in the art are familiar with a switch matrix circuit. A switch matrix is a circuit with external input ports, external output ports, and external control lines to configure the internal circuitry, which consists of a set of lines interconnected in such a way that traffic from an input port can be re-directed internally and find a path to an output port.

People skilled in the art are familiar with an Application Programming Interface (API). An Application Programming Interface (API) is an abstraction layer that defines and describes a set of functions used by components of a software system. The software that provides the functions described by an API is said to be an implementation of the API.

People skilled in the art are familiar with a Hardware Abstraction Layer (HAL). A Hardware Abstraction Layer (HAL) is an abstraction layer, implemented in software, between the physical hardware of an electronic system, and the software that runs on that electronic system. Its function is to hide differences in hardware from the software applications which are running on the hardware, so that most of the software code does not need to be changed to run on systems with different hardware.

An objective of the present invention is to upgrade a traditional vending machine with: 1) alternative payment means, and/or 2) real-time telemetry functionality, and/or 3) integrated multimedia features, and/or 4) intelligent energy management, and/or 5) add a software application programming interface to the vending machine, without replacing the conventional Vending Machine Controller board. The original Vending Machine Controller board is not replaced in the vending machine, and will still perform the normal vending operations as before. Additional features are added at the processor level of the VMC board, by removing and replacing the original microcontroller on the VMC board with an FPGA board or an electronic board. The FPGA board or electronic board can be plugged in the existing microcontroller socket on the VMC board, giving the application running on the FPGA board or the electronic board access to all elements connected to the vending machine controller, which include, but are not limited to: selection panel, display, sold-out panel, vending peripherals, vend motor, temperature sensor, cooling unit, drop sensor, door sensor.

The present invention uses In-Circuit Emulation techniques, modified emulated microcontroller peripherals, an emulated switch matrix circuit or a generic processor to add additional features to the vending machine at the processor level of the VMC board.

In all the embodiments of the present invention, the integration takes place at the processor level of the vending machine controller board: the original vending machine controller board is not replaced, but the original microcontroller on the VMC board is replaced.

SUMMARY OF THE INVENTION

The present invention relates to cost-effective methods and techniques for upgrading a traditional vending machine to a state-of-the-art vending machine with one or more of: mobile phone payment, telemetry, remote adjustment, graphical user interface, advertisement, intelligent energy management and hardware abstraction layer with common Application Programming Interface, without replacing the conventional Vending Machine Controller board. The original Vending Machine Controller board is not replaced in the vending machine, and will still perform the normal vending operations as before. Additional features are added at the processor level of the VMC board.

FIG. 1 shows a simplified Block diagram of a traditional vending machine. FIG. 2 shows a Block diagram of a Vending Machine Controller (VMC) printed circuit board. Generally, a central processor on the Vending Machine Controller (VMC) board 100 in the vending machine is responsible for the control of and activities within the vending machine, which include, but are not limited to: 1) communication with the payment system 103 to keep track of the inserted amount of credit, 2) monitor button presses on the selection panel 101 to check if the consumer selects an item, 3) control motor relay 104 in the vending machine to release a product through the dispenser unit 105, 4) monitor drop sensor 110 to check if product is sold-out, 5) monitor temperature sensor 109 and control temperature of items within the vending machine by means of the cooling system 113.

The VMC board contains a microcontroller, which is typically an Intel 8051 derived microcontroller, or a Motorola 68HC11 derived microcontroller, or other microcontroller series. In several embodiments of the present invention, the original Vending Machine Controller board 100 is not replaced in the vending machine, but the original microcontroller 112 on the VMC board is removed and replaced with an FPGA board or an electronic board, that can be plugged in the existing microcontroller socket on the VMC board, giving the application running on the FPGA board or the electronic board access to all elements connected to the vending machine controller, which include, but are not limited to: selection panel 101, display 106, sold-out panel 107, vending peripherals, vend motor relay 104, temperature sensor 109, cooling unit 113, drop sensor 110, door sensor 111.

In all the embodiments of the present invention, the integration takes place at the processor level of the vending machine controller board: the original vending machine controller board is not replaced, but the original microcontroller on the VMC board is replaced.

Given that the microcontroller types available in the vending machines deployed in the field are limited (e.g. 8051 or derivative, 68HC11 or derivative, etc.), a wide range of vending machine brands (Vendo, Dixie-Narco, Royal Vendors, etc.) and types (Soft drinks, Snacks, etc.) can be covered. The FPGA board or electronic board can support different footprint sizes (DIP, SOIC, PLCC, PQFP, etc.) and not all available processor pins on the FPGA board or electronic board have to be used in case the microcontroller socket on the VMC board has a smaller DIP footprint (16-pin, 14-pin packages, etc.).

The present invention describes different embodiments which all integrate at the processor level of the vending machine controller board, and the difference between the respective embodiments can be best understood from the following overview:

Embodiment 1

Emulated VMC microcontroller and ICE debug circuitry connected to a host computer to monitor data memory and program memory operations during normal operation of the vending machine, and to simulate/monitor vending events/statistics at the level of the memory map, change vending configurations at the level of the memory map, jump within and intercept the original vending software program, to monitor and control the vending machine from the host computer through the ICE debug circuit, without changing the original vending software program on the vending machine controller board;

Embodiment 2

Emulated VMC microcontroller and ICE debug circuitry connected to an additional emulated microprocessor to monitor data memory and program memory operations during normal operation of the vending machine, and to simulate/monitor vending events/statistics at the level of the memory map, change vending configurations at the level of the memory map, jump within and intercept the original vending software program, to monitor and control the vending machine from the additional microprocessor through the ICE debug circuit, without changing the original vending software program on the vending machine controller board;

Embodiment 3

Emulated VMC microcontroller with modified microcontroller peripherals and modified interrupt controller, that are connected to an additional emulated microprocessor, to monitor and control the vending machine from the additional microprocessor through the modified microcontroller peripherals and modified interrupt controller, without changing the original vending software program on the vending machine controller board;

Embodiment 4

Switch matrix circuitry added between the removed VMC microcontroller and the VMC board, whereby the switch matrix circuit is connected to an additional emulated microprocessor, and the switch matrix circuit can by-pass signals between the original VMC microcontroller and the VMC board, and can re-direct them to the additional microprocessor and associated peripherals for analog signal processing, to monitor and control the vending machine from the additional microprocessor through the switch matrix circuit, without changing the original vending software program on the vending machine controller board;

Embodiment 5

Emulated microprocessor running new software, which externally is pin compatible with the original VMC microcontroller, and has access to all elements connected to the vending machine controller, which include, but are not limited to: selection panel, display, sold-out panel, vending peripherals, vend motor, temperature sensor, cooling unit, drop sensor, door sensor, and the emulated microprocessor takes over the operations from the original VMC microcontroller, whereby the new software running on the microprocessor takes up the original vending operations as provided by the original vending software program, and adds new features in addition;

In one embodiment of this invention (embodiment 1), the original VMC board will still perform the normal vending operations as before using the original software in ROM, and additional features are added at the processor level of the VMC board by an external host computer applying In-Circuit Emulation techniques on the emulated VMC microcontroller. The microcontroller from the VMC board is emulated using a soft-core in an FPGA board, which includes an emulated debug circuitry that is connected to an external host computer. The In-Circuit Emulation techniques are used by the external host computer during normal operation of the vending machine to: 1) Simulate vending events at the level of the memory map, 2) Monitor vending events by monitoring data memory and program memory accesses, 3) Read out vending statistics or other parameters by reading out specific data memory locations, 4) Change vending configuration by writing to specific non-volatile data memory locations, 5) Perform a Jump instruction on demand to run some existing vending program code, 6) Enrich the original vending application with new features by intercepting access to a specific program memory location.

In another embodiment of this invention (embodiment 2), the original VMC board will still perform the normal vending operations as before using the original software in ROM, and additional features are added at the processor level of the VMC board by an additional microprocessor applying In-Circuit Emulation techniques on the emulated VMC microcontroller. The microcontroller from the VMC board is emulated using a soft-core in an FPGA board, which includes an emulated debug circuitry and an additional soft-core microprocessor that is connected to the emulated debug circuit. The In-Circuit Emulation techniques are used by the additional soft-core microprocessor in the FPGA board during normal operation of the vending machine to: 1) Simulate vending events at the level of the memory map, 2) Monitor vending events by monitoring data memory and program memory accesses, 3) Read out vending statistics or other parameters by reading out specific data memory locations, 4) Change vending configuration by writing to specific non-volatile data memory locations, 5) Perform a Jump instruction on demand to run some existing vending program code, 6) Enrich the original vending application with new features by intercepting access to a specific program memory location.

In yet another embodiment of this invention (embodiment 3), the original VMC board will still perform the normal vending operations as before using the original software in ROM, and additional features are added at the processor level of the VMC board, by emulating the VMC microcontroller using a soft-core in an FPGA board, and modifying the interrupt controller and the emulated microcontroller peripherals such as: I/O port, UART, ADC, I2C, etc., in the emulated VMC microcontroller and make these peripherals and interrupt controller observable and controllable by an additional emulated microprocessor in the FPGA, to change the behavior of the vending software without modifying the original software on the Vending Machine Controller board.

In yet another embodiment of this invention (embodiment 4), the original VMC board will still perform the normal vending operations as before using the original software in ROM, and additional features are added at the processor level of the VMC board by bypassing one or more individual pins between the VMC microcontroller and the VMC board. The original VMC microcontroller is removed from the VMC board and is plugged in an FPGA board, which includes an emulated switch matrix circuit and a soft-core microprocessor that controls the switch matrix circuit. Some pins between the original VMC microcontroller and the VMC board can be bypassed by the switch matrix circuit, which can re-direct them to the additional microprocessor and associated peripherals for analog signal processing, whereby the additional microprocessor can monitor the original signal, and leave the original signal unmodified, or can modify the signal, or create a completely new signal, to add additional functionality to the vending machine through the soft-core microprocessor, while keeping the other functionality from the original VMC microcontroller, and have it performed by the original VMC microcontroller.

In yet another embodiment of this invention (embodiment 5), the original VMC board will still perform the normal vending operations as before, using new software running on a soft-core microprocessor in the FPGA board or the electronic board, which is externally pin compatible with the original VMC microcontroller, and has access to all elements connected to the vending machine controller, which include, but are not limited to: selection panel, display, sold-out panel, vending peripherals, vend motor, temperature sensor, cooling unit, drop sensor, door sensor, whereby the new software running on the microprocessor takes up the original vending operations as provided by the original vending software program, and adds new features in addition.

The retro-fit kit described in several embodiments of the present invention is characterized in that the integration takes place at the processor level of the vending machine controller board: the original vending machine controller board is not replaced, but the original microcontroller on the VMC board is replaced.

The retro-fit kit described in several embodiments of the present invention simplifies the field upgrade procedure, limits the costs for upgrading existing vending machines and has the following advantages:

1) Can be integrated in every traditional electronic vending machine brand or type;

2) Does NOT require replacement of the original VMC board, and is easily fitted at the microcontroller socket level of the VMC board without the placement of custom interfacing cables, as microcontrollers have a standardized foot print;

3) Does NOT require an update to the original software on the VMC board to integrate the extra functionality: the original VMC board will still perform the normal vending operations as before using the original software in ROM in embodiments 1-4 of this invention (embodiment 5 uses new software implemented on a generic microprocessor);

4) Makes FULL use of the existing conventional vending machine elements, such as payment devices, selection panel, display panel, etc.;

5) Does NOT depend on custom interfacing cables to integrate in different vending machine brands and types;

6) Is protocol INDEPENDENT and does not require the knowledge and implementation of a specific vending protocol such as DEX, MDB, Executive, etc (for all vending functionality in embodiment 1-2, and for the majority of the vending functionality in embodiment 3-4);

7) Limits the amount of new elements in a modular fashion and saves cost as you only add that what you need and can expand later on: the FPGA or electronic board is integrated and several peripherals can be added: Display, Keyboard, Touch screen, GPRS modem;

8) Does NOT require the placement of a retro-fit protocol conversion kit to convert from one protocol (e.g. MDB) to another (e.g. Executive, VCCS, BDV, Micromech, Simplex III, HII, etc.) and does NOT require the removal of an existing cashless payment device that would share the same peripheral address to integrate alternative payment means;

9) Does NOT require the placement of a retro-fit MDB audit (DEX) kit and does not require the placement of extra retro-fit sensors (drop sensor, occupancy sensor, etc.) in the vending cabinet to add real-time telemetry functionality;

10) Does NOT require the placement of a universal communication unit that simulates the vending peripherals with virtual vending peripherals to add multimedia features or alternative payment means;

11) Does NOT require the placement of retro-fit sensors (drop sensor, occupancy sensor, temperature probe, etc.) to generate demand data and add intelligent energy management;

12) Provides an abstraction layer above the underlying vending hardware with a common Application Programming Interface for controlling and monitoring the upgraded vending machine, to run common interactive applications on different vending machine brands and types;

BRIEF DESCRIPTION OF THE DRAWINGS

The objects and features of the present invention will become more apparent and the invention will be best understood from the following detailed description of the preferred embodiments, when read with reference to the accompanying drawings wherein.

DETAILED DESCRIPTION

Figure 1:
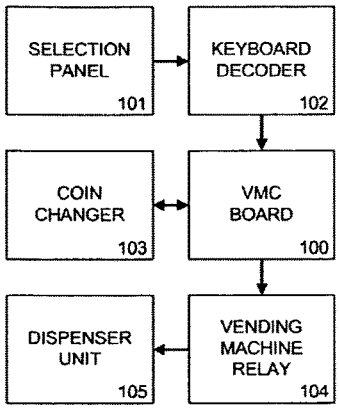
FIG. 1 is a simplified Block diagram of a traditional vending machine
Figure 2:
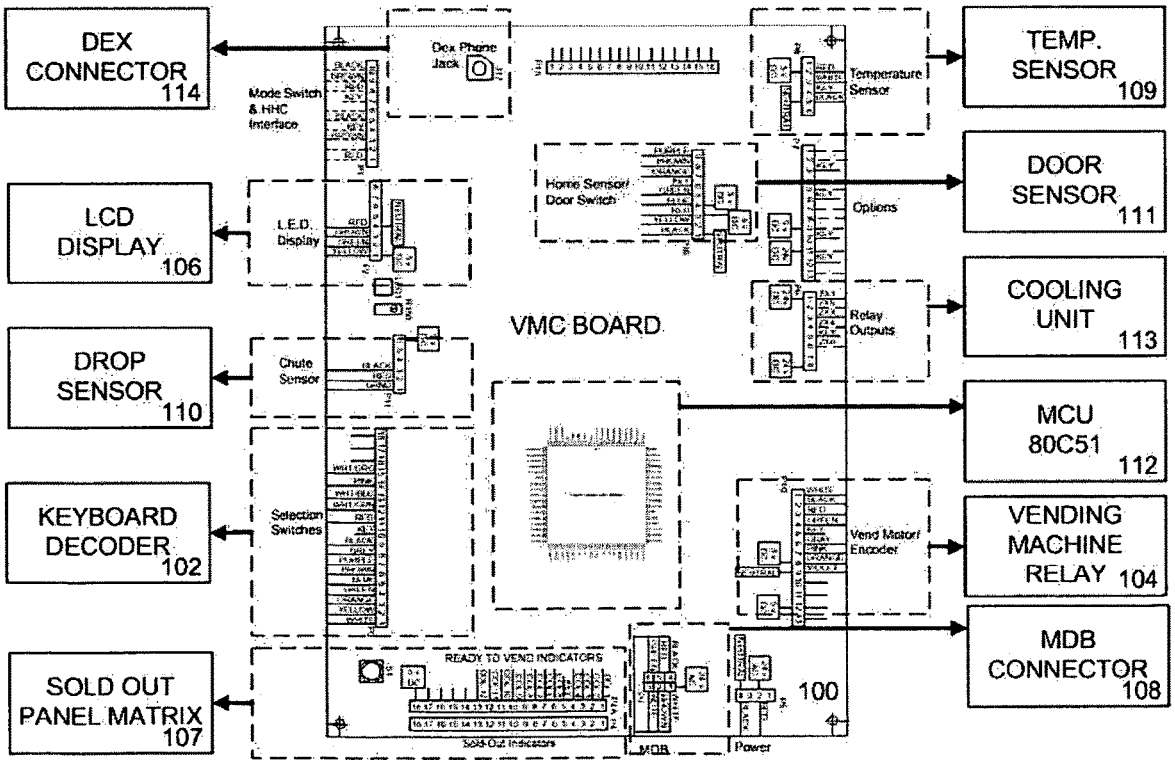
FIG. 2 is a Block diagram of a Vending Machine Controller (VMC) printed circuit board

The present invention relates to cost-effective methods and techniques for upgrading a traditional vending machine to a state-of-the-art vending machine with one or more of: mobile phone payment, telemetry, remote adjustment, graphical user interface, advertisement, intelligent energy management, hardware abstraction layer with common Application Programming Interface, without replacing the conventional Vending Machine Controller board 100, as in FIG. 2. The original Vending Machine Controller board is not replaced in the vending machine, and will still perform the normal vending operations as before. Additional features are added at the processor level of the VMC board.

In several embodiments of the present invention, the original Vending Machine Controller board 100 is not replaced in the vending machine, but the original microcontroller 112 on the VMC board 100 is removed and replaced with an FPGA board or an electronic board, that can be plugged in the existing microcontroller socket on the VMC board, giving the application running on the FPGA board or the electronic board access to all elements connected to the vending machine controller, which include, but are not limited to: selection panel 101, display 106, sold-out panel 107, vending peripherals, vend motor relay 104, temperature sensor 109, cooling unit 113, drop sensor 110, door sensor 111.

The embodiments of the present invention can be provided as a retro-fit kit to upgrade existing vending machines.

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims.

In order to simplify the understanding of the invention, rather than describing the invention in abstract terms, some of the descriptions herein are in terms of a specific processor, namely the Intel 8051 microcontroller. However, it should be understood that the invention is not limited for use by any specific processor.

Figure 3:
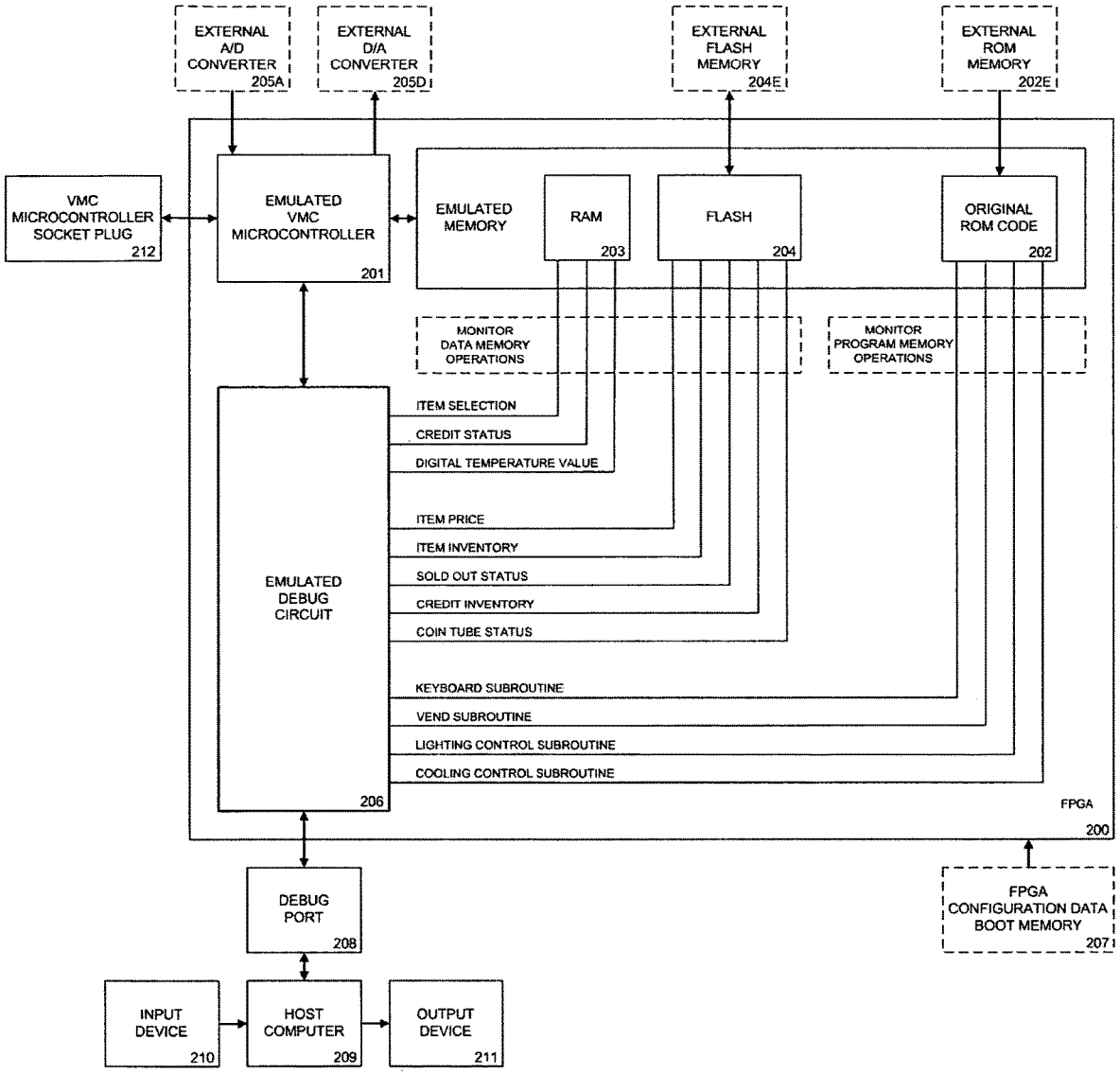
FIG. 3 is a Block diagram which illustrates the integration at the processor level of the VMC board, for the solution with emulated VMC microcontroller and ICE debug circuitry connected to host computer, and indicates the data memory and program memory accesses of interest

In one embodiment of this invention, (embodiment 1: referred to as solution with emulated VMC microcontroller and ICE debug circuitry connected to host computer as shown in FIG. 3), the original microcontroller 112 on the VMC board 100, as shown in FIG. 2, is removed from the VMC board 100 or tri-stated, and is implemented as a Soft core 201 on an FPGA board. The FPGA board emulates the original VMC microcontroller 112 and contains a group of pins with the same footprint as the original microcontroller 112 on the VMC board 100. A program memory model 202 and data memory model 203/204 is programmed in the FPGA 200 to provide a code store and data store to the emulated VMC microcontroller 201. The ROM file 202 of the original vending machine controller is completely re-used: the original VMC board 100 will still perform the normal vending operations as before using the original software, and there is no need to have access to the source code of the original software program. When the original ROM 202E is available on an external chip that provides the program to the VMC microcontroller 112, it can be re-used by an external memory interface on the FPGA board that connects to the external ROM 202E through the pins that connect to the footprint of the original VMC microcontroller 112. An external Flash memory 204E can be added on the FPGA board to provide a non-volatile data store to the emulated VMC microcontroller 201 when the FPGA 200 does not support non-volatile memory. Analog signal processing functionality in the original VMC microcontroller 112 (e.g. A/D or D/A converters) can be provided to the emulated VMC microcontroller by additional external circuitry 205A/205D added on the FPGA board, when the FPGA 200 does not support analog signal processing. Generally the A/D converter on the VMC microcontroller 112 is used for monitoring the temperature in the vending cabinet.

People skilled in the art are familiar with techniques and tools to debug microprocessor systems implemented in FPGAs, like e.g. debug logic insertion and a set of debug modules to provide soft core microprocessors with In-Circuit Emulation capabilities. In addition, the FPGA 200 is programmed with a model of monitoring or debug logic 206 which monitors the operations of the emulated VMC microcontroller 201 and provides a fully transparent window into the internal functioning of the modeled microcontroller. The inserted debug modules provide the circuit with debugging capabilities (simple event detection, signal monitoring, tracing, complex event and sequence detection, microprocessor in-circuit emulation). This type of emulation may be referred to as an On-Chip Debug System, hereinafter "OCDS". The emulated debug circuitry 206 provides advanced In-Circuit Emulation facilities to monitor and control the emulated VMC microcontroller 201: this debug circuitry 206 is referred to as ICE debug circuitry. Access to the ICE debug circuitry is provided through the JTAG port 208 on the FPGA board.

The embodiment is further characterized in that, during system integration, the emulated ICE debug circuit 206 in the FPGA 200 provides a real-time monitoring and debugging architecture that allows non-intrusive, on-the-fly examination and modification of registers, internal and external data memory 203/204, and program memory 202, using the existing JTAG pins 208 on the FPGA, without the requirement of any special monitor subroutines on the target side. It can halt, run, step into or skip an instruction, read/write any contents of the microcontroller including all registers, internal and external data memory, and program memory. Hardware breakpoints can be set and controlled on registers, internal and external data memory and program memory. The hardware breakpoint is executed if any write/read occurred at a particular address with a certain data pattern or without any data pattern. Using time stamps, external signals received via pins (e.g. a key press on the vending machine, the value of a sensor output, etc.) can be correlated with the activity occurring on the emulated VMC microcontroller 201.

The embodiment is further characterized in that, during system integration, the internal soft core In-Circuit Emulation debugging approach makes it possible to discover important data and program memory locations, by running individual test scenarios in a learn-mode in the Graphical User Interface running on a host computer system 209, which contains a source level debugging software program that cooperates with the debug logic block 206, whereby the host computer system 209 is connected to the debug logic block 206 by means of the debug port 208, and can be controlled by an input device 210 and an output device 211.

FIG. 3 indicates the data memory and program memory accesses of interest. The vending test scenarios provide the possibility to:

1) Discover the data memory location where the credit status is stored and the value corresponding to a denomination value for coins or bills with a credit status discovery test scenario: insert a coin with a specific value in the coin changer 103 or a bill with a specific value in the bill validator, and monitor which data memory location gets increased with the expected value matching to a specific denomination value;
2) Discover the data memory location (if available) where the coin tube status for a specific coin type is stored with a coin tube status discovery test scenario: insert a coin with a specific value in the coin changer 103 and monitor which data memory location gets incremented with one unit;
3) Discover the interrupt service routine that is serviced (if available) when an item selection is made with a keyboard interrupt service discovery test scenario: press a specific push button on the selection panel 101 and monitor which interrupt gets fired;
4) Discover the data memory location where the item selection is stored with an item selection discovery test scenario: press a specific push button on the selection panel 101 and monitor which data memory location gets updated with the selected item;
5) Discover the data memory location where the item price for a specific item is stored with an item price discovery test scenario: perform a vending machine setup configuration routine and monitor which non-volatile data memory location gets updated with the updated item price or press the push button on the selection panel 101 and monitor the instruction register for a compare instruction and check the operands to identify with which data memory location the current credit status is compared;
6) Discover the data memory location (if available) where the item counter for a specific item is stored with an item counter discovery test scenario: issue a vend on an item and monitor which memory location gets decreased/increased;
7) Discover the data memory location where the sold-out status for a specific item is stored with a sold-out status discovery test scenario: issue a vend on the last item, or issue a vend for an item which is no longer available in the vending machine (to have the drop sensor 110 discover it) and monitor which data memory location gets updated;
8) Discover the program memory location where the subroutine to activate the vend motor is located with a vend motor subroutine discovery test scenario: issue a vend on an item and monitor the program counter until the selected item is dispensed;
9) Discover the program memory location where the subroutine to activate the lighting behind the marquee in the vending machine, is located (if available) with a lighting activation/de-activation subroutine discovery test scenario: enable/disable the lighting by means of the vending machine setup configuration routine and monitor the program counter until the lighting is activated/de-activated;
10) Discover the program memory location where the subroutine to activate the cooling system is located (if available) with a cooling activation/de-activation subroutine discovery test scenario: increase temperature at temperature sensor 109 in the vending cabinet and monitor the program counter until the cooling system switches on;

People skilled in the art will recognize that other important data and program memory locations can be discovered by executing other vending test scenarios, and monitor the corresponding data memory locations and/or program memory locations.

The important data memory and program memory locations that are discovered by running the individual vending test scenarios are stored on the host computer 209, as they are used later on during normal operation of the vending machine.

The embodiment is further characterized in that, during normal operation of the vending machine, the original VMC board 100 will still perform the normal vending operations as before using the original software: the original ROM code 202 of the vending machine is completely re-used without any modification, but the host computer 209 can add extra functionality to the vending machine by monitoring and controlling the emulated ICE debug circuitry 206 connected to the emulated VMC microcontroller 201, providing the host computer 209 the possibility to:

1) Simulate vending events at the level of the memory map:
   1.1) Alternative payment means (e.g. mobile phone payment) can be added without any knowledge about a specific vending protocol and without the need for a custom interfacing cable, by storing the credit value in the proper memory location 203: same memory location where the original VMC microcontroller 112 stored the updated credit value after a coin or bill was inserted in the traditional vending peripheral like e.g. coin changer 103 or bill acceptor;
   1.2) A Graphical User Interface using an input device 210 and an output device 211 connected to the host computer 209, can be added for item selection on the vending machine, without any knowledge about a specific vending protocol and without the need for a custom interfacing cable, by: 1) storing the item value in the proper memory location 203: same memory location where the original VMC microcontroller 112 stored the item selection after pressing a push button on the selection panel 101 of the cabinet, and 2) triggering the expected interrupt in the interrupt controller of the emulated VMC microcontroller 201 or performing a Jump instruction on demand to run some existing vending program code 202: e.g. serve a keyboard press to emulate a keyboard press on the selection panel 101 by controlling the program counter of the emulated VMC microcontroller 201;
   1.3) Intelligent energy management can be added without any knowledge about a specific vending protocol and without the need for a custom interfacing cable, by overriding the data memory location 203 where the digital value from the A/D converter connected to the temperature probe 109 is stored. In the original vending machine without intelligent energy management, the active cooling system brings the temperature down to a specific defined temperature level, called the low-end cold temperature. The memory location can be overwritten with a digital temperature value that corresponds to that level, to simulate an ambient temperature that comes close to the low-end cold temperature and indirectly control the vending machine's cooling system;

People skilled in the art will appreciate that other vending events can be simulated at the level of the memory map by using this approach.

2) Monitor vending events by monitoring data memory and program memory accesses:

2.1) Item selection on the original selection panel 101 can be monitored without any knowledge about a specific vending protocol and without the need for a custom interfacing cable, by monitoring the respective data memory location 203 where item selection is stored, providing means to show a "item selected" message in the graphical user interface running on the host computer 209;

2.2) Coin or bill insertion on the original currency detector 103 can be monitored without any knowledge about a specific vending protocol and without the need for a custom interfacing cable, by monitoring the respective data memory location 203 where the credit status is stored, providing means to show a "credit inserted" message in the graphical user interface running on the host computer 209;

2.3) Vend success event can be monitored without any knowledge about a specific vending protocol and without the need for a custom interfacing cable, by monitoring the program memory locations 202 that get addressed, to indirectly find out if the vend motor was triggered;

People skilled in the art will appreciate that other vending events can be monitored by monitoring other data memory and program memory accesses by using this approach.

3) Read out vending statistics or other parameters by reading out specific data memory locations:

3.1) Total amount of collected cash and coin tube status can be monitored without any knowledge about a specific vending protocol and without the need for a custom interfacing cable, by reading out the respective data memory locations 204 where the total credit status and coin tube status counters are stored: if the VMC board 100 does not maintain these counters itself already, these counters can be maintained internally by the host computer 209 which detects coin insertions by monitoring the data memory location 203 where the credit status is stored;

3.2) Item inventory and sales information can be monitored without any knowledge about a specific vending protocol and without the need for a custom interfacing cable, by reading out the respective data memory locations 204 where the sold-out status and/or item counters are stored: if the VMC board 100 does not maintain these counters itself already, these counters can be maintained internally by the host computer 209 which detects item selections and vend operations by monitoring the data memory location 203 where the item selection is stored, and the program counter to check if the vend motor subroutine in the program memory 202 is called;

3.3) Temperature in the vending cabinet can be monitored without any knowledge about a specific vending protocol and without the need for a custom interfacing cable, by reading out the respective data memory location 203 where the digital value from the A/D converter connected to the temperature probe 109 is stored;

People skilled in the art will appreciate that other vending statistics and parameters can be read by reading out specific data memory locations by using this approach.

4) Change vending configuration by writing to specific non-volatile data memory locations:

4.1) Item pricing can be changed remotely without any knowledge about a specific vending protocol and without the need for a custom interfacing cable, by writing the updated pricing to the respective data memory locations 204 where the pricing values are stored for the respective items;

People skilled in the art will appreciate that other vending configuration settings can be changed by writing to specific data memory locations by using this approach.

5) Perform a Jump instruction on demand to run some existing vending program code:

5.1) Control the program counter of the emulated VMC microcontroller 201 to run the subroutine in the program memory 202 which issues a vend and activates the corresponding vending relay 104;

5.2) Control the program counter of the emulated VMC microcontroller 201 to run the subroutine in the program memory 202 which controls the relay which enables/disables the lighting system when this feature was provided in the original program code 202;

5.3) Control the program counter of the emulated VMC microcontroller 201 to run the subroutine in the program memory 202 which controls the relay which enables/disables the cooling system when this feature was provided in the original program code 202;

People skilled in the art will appreciate that other jump instructions can be performed to execute other functionality on demand by using this approach.

6) Enrich the original vending application with new features without changing the original vending software, by intercepting access to a specific program memory location on the emulated VMC microcontroller:

6.1) Implement a delayed vend scenario: after an item has been selected on the selection panel 101 of the vending machine, the emulated VMC microcontroller 201 is halted by means of a breakpoint setting, then the host computer 209 runs a program to play a video clip on a display device 211, afterwards the emulated VMC microcontroller 201 resumes from the breakpoint when the host computer 209 finished playing the video clip, and finally the vending machine dispenses the initial selected item through the dispenser unit 105;

6.2) Change the button mapping on the vending machine by overriding a recent memory write operation to the data memory 203—where the item selection is stored—before the main program loop 202 on the emulated VMC microcontroller 201 continues;

People skilled in the art will appreciate that other subroutines can be intercepted and suspended to enrich the vending application with other features by using this approach.

The embodiment is further characterized in that during service mode operation and normal operation, the host computer 209 can run a vending operator/consumer friendly Graphical User Interface which cooperates with the debug logic block 206. In service mode operation, the Graphical User Interface provides a learn mode, which contains a number of vending scenarios that the operator needs to walk through in order to discover the data memory locations 203/204 and program memory locations 202 which are used to add additional features to the vending machine at the processor level. After the learn scenarios are completed by the vending operator, the additional features are available to the vending operator and the consumer. The Graphical User Interface in service mode operation can be used for changing local pricing settings and button mappings, running local field tests (test vend cycle, test coin acceptor, look at sales statistics, display logging of events, etc.). During normal operation the Graphical User Interface can be used for item selection and provides informative messages (sold-out, low funds, credit status).

Figure 4:
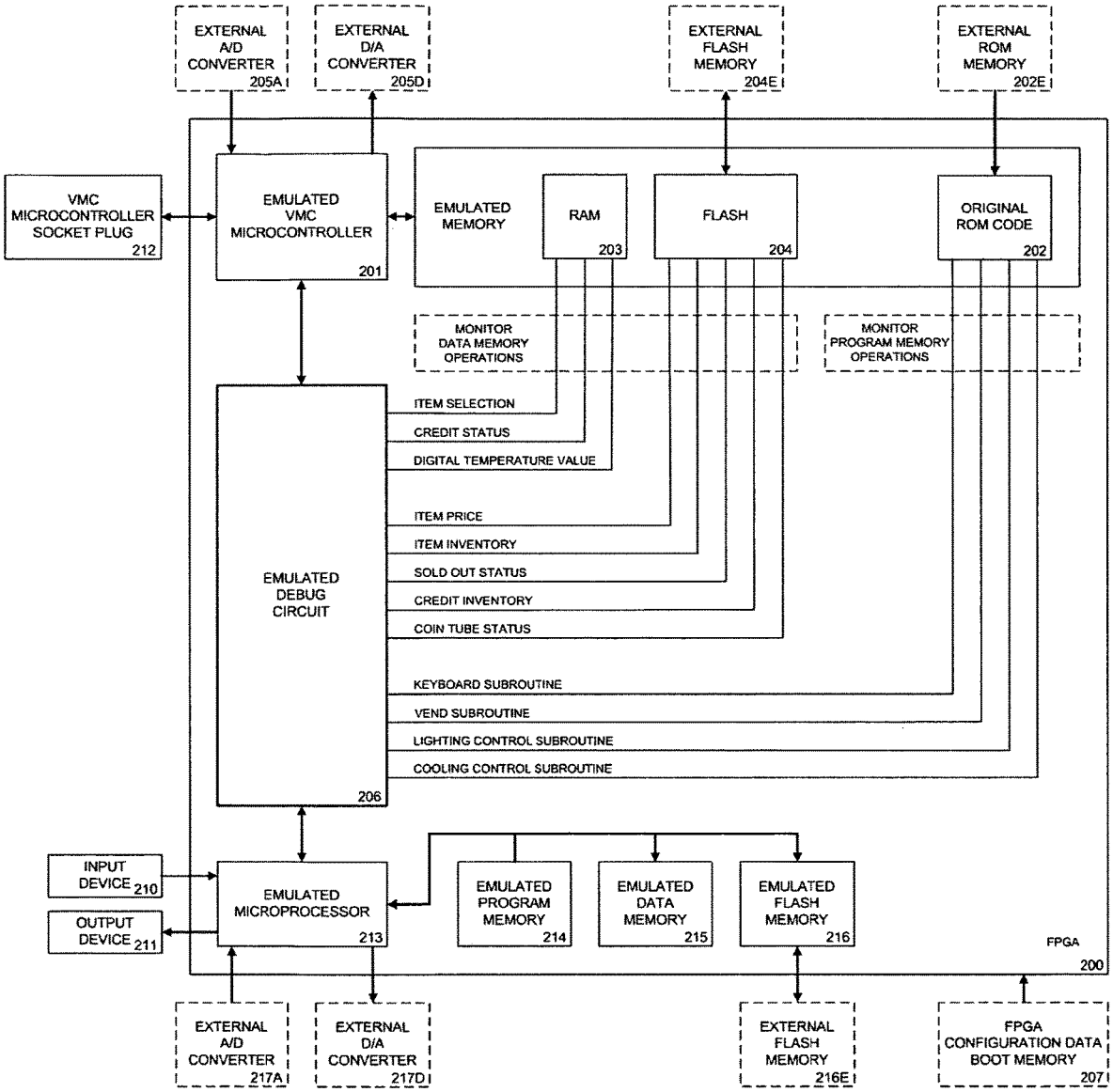
FIG. 4 is a Block diagram which illustrates the integration at the processor level of the VMC board, for the solution with emulated VMC microcontroller and ICE debug circuitry connected to an additional emulated microprocessor, and indicates the data memory and program memory accesses of interest

In another embodiment of this invention (embodiment 2: referred to as solution with emulated VMC microcontroller and ICE debug circuitry connected to emulated microprocessor as shown in FIG. 4), the original VMC microcontroller 112 is removed from the VMC board 100 or tri-stated, and is implemented as a Soft core 201 on an FPGA board. The FPGA board emulates the original VMC microcontroller 112 and contains a group of pins with the same footprint as the original microcontroller 112 on the VMC board 100. A program memory model 202 and data memory model 203/204 is programmed in the FPGA 200 to provide a code store and data store to the emulated VMC microcontroller 201. The ROM file 202 of the original vending machine controller is completely re-used: the original VMC board 100 will still perform the normal vending operations as before using the original software 202, and there is no need to have access to the source code of the original software program. When the original ROM 202E is available on an external chip that provides the program to the VMC microcontroller 112, it can be re-used by an external memory interface on the FPGA board that connects to the external ROM 202E through the pins that connect to the footprint of the original VMC microcontroller 112. An external Flash memory 204E can be added on the FPGA board to provide a non-volatile data store to the emulated VMC microcontroller 201 when the FPGA 200 does not support non-volatile memory. Analog signal processing functionality in the original VMC microcontroller 112 (e.g. A/D or D/A converters) can be provided to the emulated VMC microcontroller 201 by additional external circuitry 205A/205D added on the FPGA board, when the FPGA does not support analog signal processing. Generally the A/D converter on the VMC microcontroller 112 is used for monitoring the temperature in the vending cabinet. The FPGA 200 contains an emulated debug circuitry 206 to monitor and control the emulated VMC microcontroller 201. The emulated debug circuitry 206 includes a reduced version of an ICE debug circuitry: this debug circuitry is referred to as production debug/control circuitry. An additional microprocessor 213 is implemented as a soft core on the FPGA board which adds extra functionality to the vending machine (e.g. graphical user interface, additional payment means, etc.), and monitors/controls the production debug/control circuitry 206. A program memory model 214 and data memory model 215/216 is programmed in the FPGA 200 to provide a code store and data store to the emulated microprocessor 213. An external Flash memory 216E can be added on the FPGA board to provide a non-volatile data store to the emulated microprocessor 213 when the FPGA 200 does not support non-volatile memory. Analog signal processing functionality (e.g. A/D or D/A converters) can be provided to the emulated microprocessor 213 by additional external circuitry 217A/217D added on the FPGA board when the FPGA 200 does not support analog signal processing. Access to the production debug/control circuitry 206 is provided by an interface between the additional microprocessor 213 and the production debug/control circuitry 206.

The embodiment is further characterized in that the extra microprocessor 213 can apply the same methods as the host computer 209 in the solution with emulated VMC microcontroller and ICE debug circuitry connected to host computer.

The embodiment is further characterized in that during system integration, the important data memory 203/204 and program memory 202 locations can be discovered by running individual vending test scenarios in a learn-mode in the Graphical User Interface running on the microprocessor 213, if the microprocessor 213 implements such a learning mechanism. The important data memory and program memory locations that are discovered by running the individual vending test scenarios are stored in the data memory 215/216 of the microprocessor 213, as they are used later on during normal operation of the vending machine. Alternatively the more advanced solution with emulated VMC microcontroller and ICE debug circuitry connected to host computer, from the other embodiment in this invention, can be used to discover the important data memory and program memory locations, which are then afterwards stored in the data memory 215/216 of the microprocessor 213, and used later on for this embodiment during normal operation of the vending machine.

The embodiment is further characterized in that during normal operation of the vending machine, the production debug/control circuitry 206 monitors the emulated VMC microcontroller 201 and may output one or multiple signals to the additional microprocessor 213 upon the condition's occurrence. The produced signal may be used to signal an event to and initiate an action on the additional microprocessor 213. The interrupt controller of the emulated microprocessor 213 may be adapted to handle vending events: an event on the vending machine (item selection, coin/bill insertion, vend success, etc.) may trigger an interrupt on the emulated microprocessor 213. The additional microprocessor 213 can use the production debug/control circuitry 206 to control the emulated VMC microcontroller 201. The emulated microprocessor 213 may contain an internal microprocessor peripheral which can be configured by means of internal registers, to control the production debug/control circuitry 206. During normal operation of the vending machine, the original VMC board 100 will still perform the normal vending operations as before using the original software: the original ROM code 202 of the vending machine is completely re-used without any modification, but the additional microprocessor 213 can add extra functionality to the vending machine by monitoring and controlling the emulated debug/control circuitry 206 connected to the emulated VMC microcontroller 201, whereby the extra microprocessor 213 can apply the same methods as the host computer 209 in the solution with emulated VMC microcontroller and ICE debug circuitry connected to host computer: 1) Simulate vending events at the level of the memory map, 2) Monitor vending events by monitoring data memory and program memory accesses, 3) Read out vending statistics or other parameters by reading out specific data memory locations, 4) Change vending configuration by writing to specific non-volatile data memory locations, 5) Perform a Jump instruction on demand to run some existing vending program code, 6) Enrich the original vending application with new features without changing the original vending software, by intercepting access to a specific program memory location on the emulated VMC microcontroller.

Figure 5:
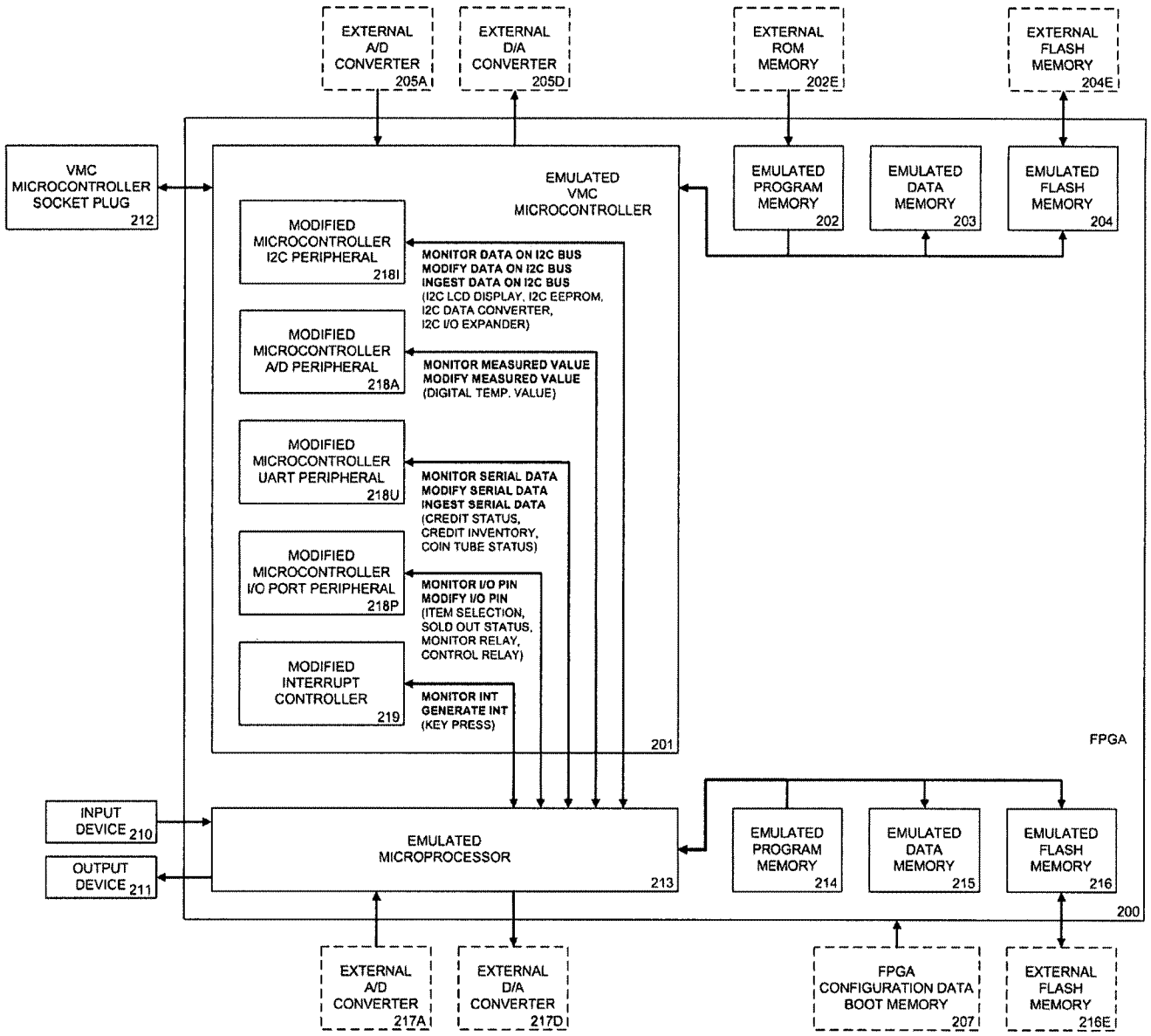
FIG. 5 is a Block diagram which illustrates the integration at the processor level of the VMC board, for the solution with emulated VMC microcontroller and modified on-board microcontroller peripherals connected to an additional emulated microprocessor

In yet another embodiment of this invention (embodiment 3: referred to as solution with emulated VMC microcontroller, and modified on-board microcontroller peripherals connected to an additional emulated microprocessor as shown in FIG. 5), the original microcontroller 112 on the VMC board 100 is removed from the VMC board 100 or tri-stated, and is implemented as a Soft core 201 on an FPGA board, and the on-board microcontroller peripherals 218I, 218A, 218U, 218P and interrupt controller 219 of the emulated VMC microcontroller 201 are modified and controllable by an additional microprocessor 213, to change the behavior of the vending software without modifying the original software 202 on the Vending Machine Controller board 100. The FPGA board emulates the original VMC microcontroller 112 and contains a group of pins with the same footprint as the original microcontroller 112 on the VMC board 100. A program memory model 202 and data memory model 203/204 is programmed in the FPGA 200 to provide a code store and data store to the emulated VMC microcontroller 201. The ROM file 202 of the original vending machine controller is completely re-used: the original VMC board 100 will still perform the normal vending operations as before using the original software, and there is no need to have access to the source code of the original software program. When the original ROM 202E is available on an external chip that provides the program to the VMC microcontroller 112, it can be re-used by an external memory interface on the FPGA board that connects to the external ROM 202E through the pins that connect to the footprint of the original VMC microcontroller 112. An external Flash memory 204E can be added on the FPGA board to provide a non-volatile data store to the emulated VMC microcontroller 201 when the FPGA 200 does not support non-volatile memory. Analog signal processing functionality in the original VMC microcontroller 112 (e.g. A/D or D/A converters) can be provided to the emulated VMC microcontroller 201 by additional external circuitry 205A/205D added on the FPGA board, when the FPGA 200 does not support analog signal processing. Generally the A/D converter on the microcontroller 112 is used for monitoring the temperature in the vending cabinet. An additional microprocessor 213 is implemented as a soft core on the FPGA board which observes and controls the modified on-board microcontroller peripherals 118 and modified interrupt controller 119 of the emulated VMC microcontroller 201. A program memory model 214 and data memory model 215/216 is programmed in the FPGA 200 to provide a code store and data store to the emulated microprocessor 213. An external Flash memory 216E can be added on the FPGA board to provide a non-volatile data store to the emulated microprocessor 213 when the FPGA 200 does not support non-volatile memory. Analog signal processing functionality (e.g. A/D or D/A converters) can be provided to the emulated microprocessor 213 by additional external circuitry 217A/217D added on the FPGA board when the FPGA 200 does not support analog signal processing. The on-board microcontroller peripherals 218I, 218A, 218U, 218P and interrupt controller 219 of the emulated VMC microcontroller 201 are modified and observable/controllable by the additional microprocessor 213, to change the behavior of the vending software without modifying the original software 202 on the Vending Machine Controller board 100, and provide the following functionality:

1) The Interrupt controller 219 of the emulated VMC microcontroller 201 is changed to make it observable/controllable by the additional microprocessor 213: the additional microprocessor 213 can monitor interrupts on the emulated VMC microcontroller 201 or can generate an interrupt on the emulated VMC microcontroller 201 to simulate an external interrupt on the vending machine: e.g. item selection interrupt, without changing the original software 202 on the Vending Machine Controller board 100;

2) The I/O port peripheral 218P of the emulated VMC microcontroller 201 is changed to make it observable/controllable by the additional microprocessor 213: the additional microprocessor 213 can monitor and interpret the logical levels of the input pins (e.g. read out item selection when a keyboard interrupt is generated) and the output pins in the I/O port (e.g. read out sold-out panel status, monitor signal to vend motor relay), and can optionally bypass them from the VMC board 100 and override them (e.g. pass on its own item selection to the emulated VMC microcontroller, delay a signal to the vend motor relay), without modifying the original software 202 on the Vending Machine Controller board 100;

3) The UART peripheral 218U of the emulated VMC microcontroller 201 is changed to make it observable/controllable by the additional microprocessor 213: the additional microprocessor 213 can monitor the serial data (e.g. monitor credit activity from the existing payment peripherals), the modified UART peripheral 218U can perform actual conversion from one protocol to another protocol, or can ingest additional serial data, without changing the original software 202 on the Vending Machine Controller board 100. The converted serial data can be used to support an additional serial vending protocol, while the ingested serial data can be used to simulate a coin or bill event to increase the internal credit status, or can be used to send a disable command to a vending peripheral: this allows for disabling of individual peripherals for various reasons, for example, power management techniques;

4) The A/D peripheral 218A of the emulated VMC microcontroller 201 is changed to make it observable/controllable by the additional microprocessor 213: the additional microprocessor 213 can monitor the digital value corresponding to the actual analog value from the temperature probe 109, and can configure the A/D peripheral 218A to either pass on that digital value to the emulated VMC microcontroller 201 or bypass it with its own digital value to simulate an ambient temperature that comes close to the low-end cold temperature and indirectly control the vending machine's cooling system without modifying the original software 202 on the Vending Machine Controller board 100. The original software program 202 running on the emulated VMC microcontroller 201 will measure a temperature which is low enough, and will stop the compressor and evaporator, which will reduce the energy consumption. The actual digital value received at the emulated VMC microcontroller 201 can be made dependant on additional parameters: e.g. time of day, day of week, sales information, occupancy information, etc. The sales information and occupancy information can be collected by monitoring the other modified microcontroller peripherals 218I, 218U, 218P and the modified interrupt controller 219 of the emulated VMC microcontroller 201 on the additional microprocessor 213;

5) The I2C peripheral 218I of the emulated VMC microcontroller 201 is changed to make it observable/controllable by the additional microprocessor 213: the additional microprocessor 213 can monitor and interpret the data which passes through on the I2C bus: e.g. data written to display 106, memory accesses to an external I2C memory, etc., and can use this observed data to control other functionality. The additional microprocessor 213 can modify existing arriving data on the I2C bus before it arrives at the emulated VMC microcontroller 201, or can send its own data on the I2C bus to control an existing I2C device, without modifying the original software 202 on the Vending Machine Controller board 100;

People skilled in the art will appreciate that other on-board microcontroller peripherals can be changed or bypassed in the emulated VMC microcontroller to change the existing behaviour without modifying the original VMC software by using this approach.

Figure 6:
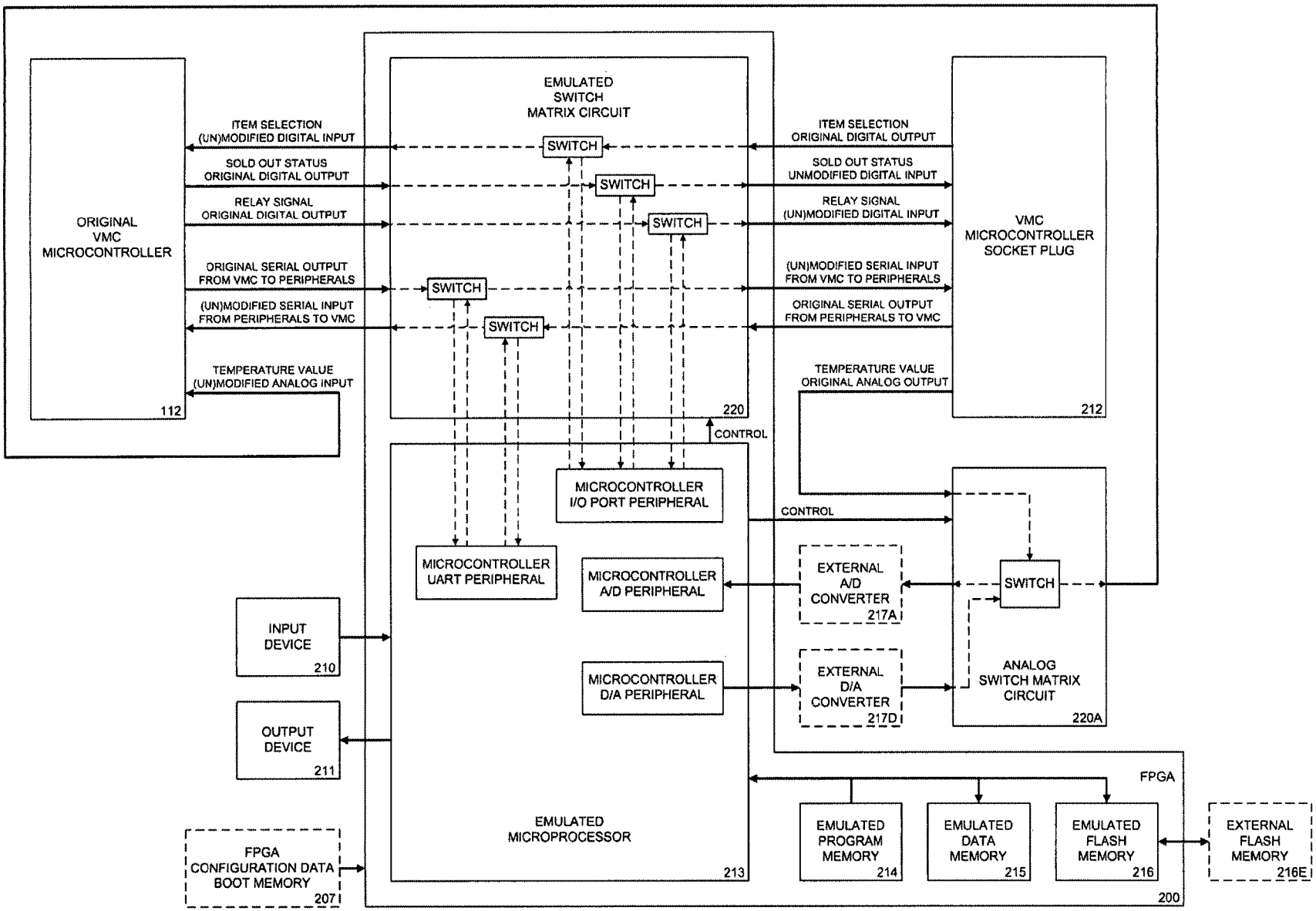
FIG. 6 is a Block diagram which illustrates the integration at the processor level of the VMC board, for the solution with emulated switch matrix circuit between the original VMC microcontroller and the VMC board, whereby the switch matrix circuit is controlled by an additional emulated microprocessor

In yet another embodiment of this invention (embodiment 4: referred to as solution with emulated switch matrix circuit controlled by an additional emulated microprocessor as shown in FIG. 6), the original microcontroller 112 is removed from the VMC board 100 and replaced by an FPGA board which contains a group of pins with the same footprint as the original microcontroller 112 on the VMC board 100. Either the original VMC microcontroller 112 is physically re-used and plugged in an empty microcontroller socket on the FPGA board, or is implemented as a Soft core 201 on the FPGA board. The FPGA 200 is programmed with an emulated switch matrix circuit 220 and an additional microprocessor 213 implemented as a soft core. A program memory model 214 and data memory model 215/216 is programmed in the FPGA 200 to provide a code store and data store to the emulated microprocessor 213. An external Flash memory 216E can be added on the FPGA board to provide a non-volatile data store to the emulated microprocessor 213 when the FPGA 200 does not support non-volatile memory. Analog signal processing functionality (e.g. A/D or D/A converters) can be provided to the emulated microprocessor 213 by additional external circuitry 217A/217D added on the FPGA board when the FPGA 200 does not support analog signal processing. The emulated switch matrix circuit 220 is capable of re-directing both digital signals and analog signals, by means of additional external circuitry added on the FPGA board: an analog switch matrix circuit 220A. The digital switch matrix circuit can either be part of the emulated switch matrix circuit 220 programmed in the FPGA 200, or can be added as external circuitry 220D to the FPGA board, just like the analog switch matrix circuit 220A. The emulated switch matrix circuit 220 is connected to the microcontroller socket on the VMC board 100, the VMC microcontroller 112, and the emulated microprocessor 213 which can contain additional circuitry 217A/217D for analog signal processing. The emulated switch matrix circuit 220 is configured and controlled by the emulated microprocessor 213. The emulated switch matrix circuit 220 can disconnect or bypass one or more individual pins of the VMC microcontroller 112, and provides the following functionality:

1) The emulated switch matrix circuit 220 can disconnect the paths between one or more individual pins from the VMC microcontroller 112 to the microcontroller socket on the VMC board 100, and wire the corresponding pins from the microcontroller socket on the VMC board 100 with some pins of the emulated microprocessor 213;

2) The emulated switch matrix circuit 220 can disconnect the paths between one or more individual pins from the microcontroller socket on the VMC board 100 to the VMC microcontroller 112, and wire the corresponding pins from the VMC microcontroller 112 with some pins of the emulated microprocessor 213;

3) The emulated switch matrix circuit 220 can by-pass the paths between one or more individual pins from the VMC microcontroller 112 to the microcontroller socket on the VMC board 100: some traffic from the VMC microcontroller 112 to the VMC board 100 and some traffic from the VMC board 100 to the VMC microcontroller 112 will pass through the emulated microprocessor 213, which can monitor or modify the traffic that passes through. The traffic which passes through the emulated microprocessor 213 can also pass through the additional circuitry 217A/217D for analog signal processing;

An original digital signal going from the VMC board 100 to the VMC microcontroller 112, can be monitored by the emulated microprocessor 213, and can be kept unmodified as the original digital signal, or can be changed to a modified digital signal, or can be disconnected and a new digital signal is independently created, by the emulated microprocessor 213, before the digital signal arrives at the VMC microcontroller 112.

An original digital signal going from the VMC microcontroller 112 to the VMC board 100, can be monitored by the emulated microprocessor 213, and can be kept unmodified as the original digital signal, or can be changed to a modified digital signal, or can be disconnected and a new digital signal is independently created, by the emulated microprocessor 213, before the digital signal arrives at the VMC board 100.

An original analog signal going from the VMC board 100 to the VMC microcontroller 112, can be monitored by the emulated microprocessor 213 after converting it to a digital value by means of the A/D converter 217A, and can be converted back by the D/A converter 217D, and can be kept unmodified as the original analog signal, or can be changed to a modified analog signal, or can be disconnected and a new analog signal is independently created, by the emulated microprocessor 213, before the analog signal arrives at the VMC microcontroller 112.

An original analog signal going from the VMC microcontroller 112 to the VMC board 100, can be monitored by the emulated microprocessor 213 after converting it to a digital value by means of the A/D converter 217A, and can be converted back by the D/A converter 217D, and can be kept unmodified as the original analog signal, or can be changed to a modified analog signal, or can be disconnected and a new analog signal is independently created, by the emulated microprocessor 213, before the analog signal arrives at the VMC board 100.

The embodiment is further characterized in that some pins of the VMC microcontroller 112 or pins of the VMC board 100 can be disconnected or bypassed to add additional functionality to the vending machine, while keeping the other functionality from the original VMC microcontroller 112, and have it performed by the original software 202:

1) The selection panel 101 can be by-passed at the processor level by bypassing the corresponding I/O port which is connected to the keyboard decoder 102: the graphical user interface running on the emulated microprocessor 213 can monitor the item selection on selection panel 101 or can take over item selection;

2) The sold-out status can be monitored at the processor level by reading out the voltage levels of the sold-out led panel 107: the graphical user interface running on the emulated microprocessor 213 can indicate item availability;

3) The communication between the currency detector 103 and the VMC microcontroller 112 can be monitored and intercepted at the processor level: the graphical user interface running on the emulated microprocessor 213 can indicate the credit status or add alternative payment means;

4) The temperature sensor 109 can be by-passed at the processor level to simulate an ambient temperature that comes close to the low-end cold temperature. The real measured analog value at the input of the A/D converter, connected to or integrated in the VMC microcontroller 112, is replaced by an artificial analog value generated by the D/A converter 217D, connected to the additional microprocessor 213. The original software program 202 running on the original VMC microcontroller 112 will measure a temperature which is low enough, and will stop the compressor and evaporator, which reduces energy consumption;

5) The signals to the vend motor relay 104 can be monitored and intercepted at the processor level and can be delayed in time or duplicated: to monitor vend transactions and implement a delayed vend scenario or multi-vend feature at the vend motor level;

People skilled in the art will appreciate that other pins of the VMC microcontroller 112 or other pins of the VMC board 100 can be disconnected or bypassed to change the existing behaviour on the vending machine and add additional functionality to the vending machine at the processor level.

The solution with the emulated switch matrix circuit can implement a fallback mechanism: a watchdog function can be implemented in the emulated switch matrix circuit 220 that connects all pins of the original VMC microcontroller 112 to the corresponding pins on the VMC board 100 for backup operation when the application 214 on the emulated microprocessor 213 is not running as expected.

Figure 7:
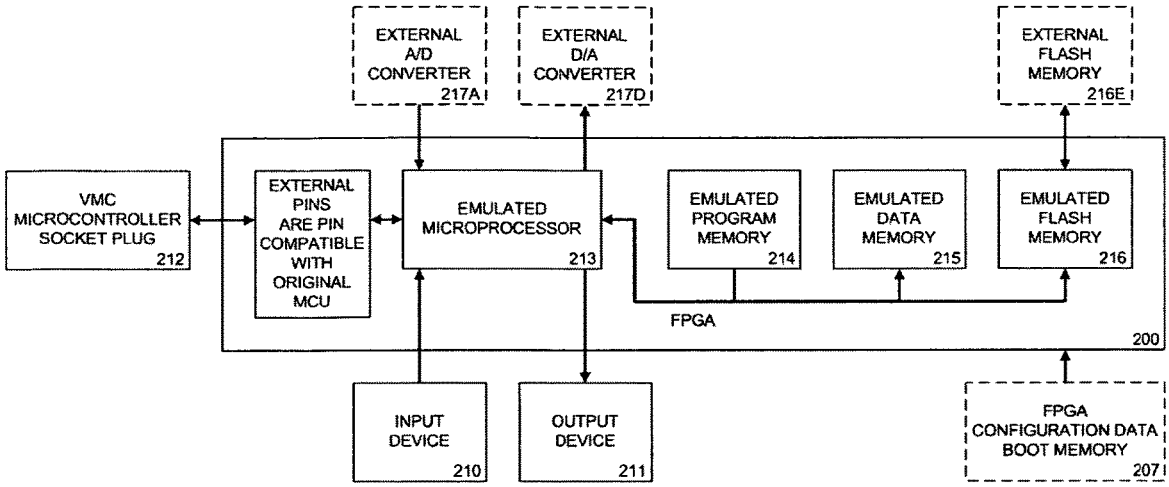
FIG. 7 is a Block diagram which illustrates the integration at the processor level of the VMC board, for the solution with an emulated generic microprocessor which is externally pin compatible with the original VMC microcontroller and takes over the operations from the original VMC microcontroller using new software.

In yet another embodiment of this invention (embodiment 5: referred to as solution with an emulated generic microprocessor which takes over the operations from the original VMC microcontroller as shown in FIG. 7), the original VMC microcontroller 112 is removed from the VMC board 100 and replaced by an FPGA board which contains a group of pins with the same footprint as the original microcontroller 112 on the VMC board 100. The FPGA 200 is programmed with a model of a generic microprocessor 213, which is externally pin compatible with the original VMC microcontroller 112, and which takes over the operations from the original VMC microcontroller 112. The FPGA board does not emulate the original VMC microcontroller 112 and the ROM file 202 of the original vending machine is not re-used. A program memory model 214 and data memory model 215/216 is programmed in the FPGA 200 to provide a code store and data store to the emulated microprocessor 213. An external Flash memory 216E can be added on the FPGA board to provide a non-volatile data store to the emulated microprocessor 213 when the FPGA 200 does not support non-volatile memory. Analog signal processing functionality (e.g. ND or D/A converters) can be provided to the emulated microprocessor 213 by additional external circuitry 217A/217D added on the FPGA board when the FPGA 200 does not support analog signal processing. The emulated microprocessor 213 in the FPGA board runs program code 214 that supports similar features as in the original program code 202 running on the original VMC microcontroller 112, including, but not limited to: 1) communication with the payment system 103 to keep track of the inserted amount of credit, 2) monitor button presses on the selection panel 101 to check if the consumer selects an item, 3) control motor relay 104 in the vending machine to release a product through the dispenser unit 105, 4) monitor drop sensor 110 to check if product is sold-out, 5) monitor temperature sensor 109 and control temperature of items within the vending machine by means of the cooling system 113, and implements additional features in addition to the original functionality, including, but not limited to: item selection in a graphical user interface controlled by an input device 210 and an output device 211, alternative payment options, implement delayed vend scenario with advertisement, monitor stock inventory, intelligently control cooling unit. The vending machine manufacturer can provide a system diagram and can clarify the respective I/O interfaces on the VMC board 100. Given that all the elements and functionality could be accessed by the original VMC microcontroller 112, it is not an issue to access the same elements and functionality through the FPGA board that is plugged in the existing microcontroller socket on the VMC board 100, and which takes over the operations from the original VMC microcontroller 112.

The microprocessor 213 on the FPGA board in several embodiments of the present invention, or the host computer 209 connected to the JTAG port 208 of the FPGA board in one embodiment of the present invention, can implement a Hardware Abstraction Layer with a common high-level Application Programming Interface which makes abstraction of the actual underlying vending hardware. Interactive Vending applications implemented on top of the Hardware Abstraction Layer will run out-of-the-box on different vending machine brands and types. The developer can focus on the interactivity of the vending application, rather than on the specific details of the vending machine on which it is implemented. This will allow the vending operator, to run the same interactive Vending portal written in C++ or another embedded software language on different vending machine brands and types that are equipped with the retro-fit kit.

The implementation and configuration of the custom low-level Hardware Abstraction Layer in the solutions based on an ICE debug circuit 206, can be completed by executing a set of learning scenarios which discover the respective data memory locations 203/204 and program memory locations 202. The graphical user interface running on the host computer 209 or running on the extra microprocessor 213 in the FPGA board can present the learning scenarios, which the vending operator has to walk through before the vending machine is setup and ready to apply the additional functionality provided by the In-Circuit Emulation techniques.

The implementation and configuration of the custom low-level Hardware Abstraction Layer in the solution in which the microcontroller peripherals 218I, 218U, 218A, 218P and interrupt controller 219 are modified in the emulated VMC microcontroller 201, or the solution based on an emulated switch matrix circuit 220, or the solution in which the original VMC microcontroller 112 is not emulated but a generic microprocessor 213 takes over the operation, can be done in close cooperation with the vending machine manufacturer for specific types of vending machines.

One FPGA board can support several Hardware Abstraction Layers, whereby the actual vending machine controller and vending machine type can be selected within a configuration menu in the Graphical User Interface.

Some Examples of the Functionality Provided by the High-Level Vending Application Programming Interface:

Monitor and control the vending machine during normal operation:

1) API functions to read out vending status information:

e.g. credit status, item pricing and sold-out status for a specific item, temperature, etc.;

2) API functions to register a callback function which gets called in case of a specific event:

e.g. coin/bill inserted, selection made, item sold-out, high temp., communication error, etc.;

3) API functions to trigger an action on the vending machine: e.g. select an item, issue vend of an item, enable/disable the cooling unit, enable/disable the lighting system, etc.;

4) API function to increase the internal credit status to handle extended payment methods:

e.g. mobile phone payment, internet payments, etc.;

5) API function to override the measured temperature value with a low-end cold temperature;

6) API functions for remote control: update pricing settings, change button mapping, etc.;

7) API functions to retrieve statistics from the vending cabinet: sales statistics, events, etc.;

Test and configure the vending machine during service mode:

1) API functions to perform test operations on the vending cabinet:

e.g. test vend cycle, test coin acceptor, test drop sensor, read-out temperature sensor, etc.;

2) API functions to configure settings on the vending cabinet:

e.g. change local pricing settings, change button mapping, etc.;

3) Configure telemetry settings for remotely monitoring the vending machine:

e.g. reporting frequency, logging, etc.;

The microprocessor 213 on the FPGA board in several embodiments of the present invention, or the host computer 209 connected to the JTAG port 208 of the FPGA board in one embodiment of the present invention, can implement a Graphical User Interface for controlling and monitoring the vending machine during normal operation and service mode operation, whereby the Graphical User Interface is controlled by an input device 210 and an output device 211.

The microprocessor 213 on the FPGA board in several embodiments of the present invention, or the host computer 209 connected to the JTAG port 208 of the FPGA board in one embodiment of the present invention, can run a local web server that provides remote access to a remote client to remotely monitor and control the vending machine.

The microprocessor 213 on the FPGA board in several embodiments of the present invention, or the host computer 209 connected to the JTAG port 208 of the FPGA board in one embodiment of the present invention, can run a local web browser environment that supports JavaScript extensions implemented on top of the low-level Hardware Abstraction Layer which hides the underlying vending hardware, to monitor and control the vending machine from within a local HTML/JS browser environment. This will allow the vending operator, to run the same interactive Vending portal written in HTML/JS on different vending machine brands and types that are equipped with the retro-fit kit.

The microprocessor 213 on the FPGA board in several embodiments of the present invention, or the host computer 209 connected to the JTAG port 208 of the FPGA board in one embodiment of the present invention, can offer extended payment options (mobile phone payment, internet payment), and can offer a feature to deposit the money inserted in the currency detector 103, to an online account that can be charged.

The microprocessor 213 on the FPGA board in several embodiments of the present invention, or the host computer 209 connected to the JTAG port 208 of the FPGA board in one embodiment of the present invention, can run a distributed advertising application. This solution comprises a distributed Client-server model for regional advertising: After creating an account on a central web server, local advertisers can advertise on the vending machines by logging in on the web server, where they can upload a commercial clip, or select a template and fill in details about an event, temporary sales campaign, etc., and afterwards can select on a city map the respective vending machines in the region on which they want to advertise, together with the frequency and duration period of their commercial campaign. The solution can implement a delayed vend scenario, whereby the item is dispensed only after a short commercial clip or advertisement message has been shown.

The embodiments of the present invention can be provided as a retro-fit kit to upgrade existing vending machines, or can be installed in a new vending machine during production in the factory.

Those skilled in the art will understand that although an FPGA is used in several embodiments of the present invention, this is not to be limiting. An FPGA is used as a convenient mechanism to implement the virtual microcontroller, microprocessor, debug circuit, switch matrix circuit, used in the present invention. However, other hardware and/or software equivalents could equally well function without the limitation of being fabricated using an FPGA. The present invention could be implemented using hardware component equivalents such as special purpose hardware and/or dedicated processors.

It should be apparent to one skilled in the art that the present invention may be practiced without the specific details described in the embodiments. In some instances, well known circuits and devices are shown in block diagram form in order not to obscure the present invention unnecessarily. It is appreciated that the steps in the described methods may be performed in an order different than presented, and that not all the steps may be performed.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

The main vending software loop in a vending machine is responsible for the control of and the activities in the vending machine. In traditional vending machines, the main vending software loop is hard-coded, and it is very difficult and almost impossible to change the behavior of the main vending software loop in the vending machine. The main vending software loop is In most of the times low-level software code, specifically designed for a specific hardware architecture, meaning that it is difficult to read, hard to change and hard to maintain.

The apparatus disclosed in the invention from Felique is used to change the behavior of the main vending software loop in the vending machine, which is responsible for the control of and the activities in the vending machine. Using the invention from Felique it is possible to control and/or monitor the main vending software loop in the vending machine.

The apparatus disclosed in the invention from Felique does not control and/or monitor the main vending software loop in the vending machine for debugging purposes, but the apparatus controls and/or monitors the main vending software loop in the vending machine during normal operation and/or during service mode operation, to control and/or monitor the vending machine from a microprocessor or a host computer. The microprocessor or host computer takes over the control and the monitoring of the vending machine during normal operation and during service mode operation. It is possible with the apparatus to control the behavior of the main vending software loop in the vending machine from a microprocessor or a host computer.

The apparatus disclosed in the invention from Felique controls and/or monitors the main vending software loop in the vending machine, by controlling and/or monitoring status information, and/or configuration data, and/or one or more events, and/or one or more activities, in the vending machine. It is possible to intercept an activity, suspend an activity, resume an activity, take over an activity, modify an activity, replace an activity, skip an activity, change the order of an activity, postpone an activity, initiate an activity, implement an activity, or insert an activity, in the main vending software loop.

The apparatus disclosed in the invention from Felique can be used to add one or more additional features to a vending machine, by controlling and/or monitoring the main vending software loop in the vending machine. These additional features comprise one or more of, but are not limited to: graphical user interface, multimedia features, advertising, info kiosk capabilities, delayed vending scenario, alternative payment options, telemetry, remote adjustment, Intelligent energy management, multi-vend feature, fallback mechanism, protocol conversion. These additional features are implemented on a microprocessor or a host computer, or are made available through a microprocessor or a host computer.

Using the apparatus disclosed in the invention from Felique, it is possible to control and/or monitor a vending machine from a software application programming interface (API) library. The software API library is used by a software application to control and/or monitor the vending machine. The apparatus controls and/or monitors the main vending software loop in the vending machine. The apparatus can be integrated into a vending machine, without replacing the vending machine controller board and without changing the vending software program in the vending machine. The main vending software loop, implemented by the vending software program, is still responsible for the control of and the activities in the vending machine, but the main vending software loop is controlled and/or monitored by the apparatus. Software applications can be developed for existing and/or new vending machines, without knowing the technical hardware/software details of the vending machine. The software application can control and/or monitor different vending machine brands and/or types.

With the solution disclosed In the invention from Felique, software developers can develop software applications for existing and new vending machines, without knowing the technical hardware/software details of the vending machine. These software applications can change the main vending software loop in the vending machine. This provides a lot of flexibility to the main vending software loop in the vending machine. From now on, the main vending software loop is no longer fixed, but can be adapted in a very flexible way at any point in time. This allows software developers to easily change the interactivity of the vending machine without knowing the technical hardware/software details of the vending machine.

CONCLUSION

Based on the foregoing remarks, the applicant believes that the application is In condition for allowance. If the Examiner has any questions regarding the case, the Examiner is invited to contact Applicant at the number given below.

Applicant would like to get an invitation for a conference call with the Examiner in case there are still issues with the claims, in order to facilitate the patent application process for both parties.

The invention claimed is:

1. An apparatus to control and/or monitor a vending machine, said vending machine comprising:

a vending machine controller board;

a microcontroller (A);

a vending software program running on said microcontroller (A);

an interface between said microcontroller (A) and said vending machine controller board;

an interface between said vending machine controller board and said vending machine, said apparatus comprising:

a microprocessor (B) or a host computer;

a debug circuit;

an interface between said microprocessor (B) or said host computer and said debug circuit;

an interface between said debug circuit and said microcontroller (A), said vending software program controls/and or monitors said vending machine during normal operation and/or during service mode operation, said vending software program controls and/or monitors status information, and/or configuration data, and/or one or more events, and/or one or more activities, in said vending machine, during normal operation and/or during service mode operation, said apparatus controls and/or monitors said vending machine from said microprocessor (B) or said host computer, through said debug circuit, during normal operation and/or during service mode operation, said debug circuit controls and/or monitors said status information, and/or said configuration data, and/or said one or more events, and/or said one or more activities, in said vending machine, during normal operation and/or during service mode operation, said apparatus controls and/or monitors said vending software program from said microprocessor (B) or said host computer, through said debug circuit, during normal operation and/or during service mode operation, by controlling and/or monitoring the same said status information, and/or the same said configuration data, and/or the same said one or more events, and/or the same said one or more activities, in said vending machine, as said vending software program, during normal operation and/or during service mode operation, said apparatus implements and/or uses a software application programming interface (API) library for said vending machine, said software application programming interface (API) library is implemented on said microprocessor (B) or said host computer, and/or said debug circuit, and/or said microcontroller (A), said software application programming interface (API) library provides one or more software API functions to control and/or monitor said status information, and/or said configuration data, and/or said one or more events, and/or said one or more activities, in said vending machine, during normal operation and/or during service mode operation.

2. The apparatus according to claim 1, wherein said apparatus controls and/or monitors said vending machine without replacing said vending machine controller board in said vending machine, said vending machine controller board controls and/or monitors said vending machine, but said vending machine controller board is controlled and/or monitored by said apparatus.

3. The apparatus according to claim 1, wherein said apparatus controls and/or monitors said vending machine without changing said vending software program in said vending machine, said vending software program controls and/or monitors said vending machine, but said vending software program is controlled and/or monitored by said apparatus.

4. The apparatus according to claim 1, wherein said apparatus adds one or more features to said vending machine, said features are implemented or available on said microprocessor (B) or said host computer, and/or are made available through said microprocessor (B) or said host computer.

5. The apparatus according to claim 4, wherein said features comprise one or more of: 1) graphical user interface; 2) multimedia features; 3) advertising; 4) info kiosk capabilities; 5) delayed vending scenario; 6) alternative payment options; 7) telemetry; 8) remote adjustment; 9) intelligent energy management; 10) multi-vend feature; 11) fallback mechanism; 12) protocol conversion.

6. The apparatus according to claim 1, wherein said apparatus comprises one or more additional interfaces, and/or wherein one or more additional interfaces are added to and/or in said apparatus, said apparatus adds said additional interfaces to said vending machine through said interface with said microcontroller (A), said additional interfaces are used to connect one or more peripherals to said vending machine, and/or to interface with one or more hardware and/or software systems.

7. The apparatus according to claim 6, wherein an input device is connected to said microprocessor (B) or said host computer, said input device transfers data to said vending machine via said microprocessor (B) or said host computer, and/or said input device is used for user interaction with said vending machine, and/or said input device is used to transfer data from one or more hardware and/or software systems to said vending machine.

8. The apparatus according to claim 6, wherein an output device is connected to said microprocessor (B) or said host computer, said microprocessor (B) or said host computer transfers data from said vending machine to said output device, and/or said output device is used to display information on said vending machine, and/or said output device is used to transfer data from said vending machine to one or more hardware and/or software systems.

9. The apparatus according to claim 1, wherein said apparatus intercepts said one or more activities, suspends said one or more activities, resumes said one or more activities, takes over said one or more activities, modifies said one or more activities, replaces said one or more activities, skips said one or more activities, changes the order of said one or more activities, postpones said one or more activities, initiates said one or more activities and/or one or more new activities, implements said one or more activities and/or one or more new activities, and/or inserts said one or more activities and/or one or more new activities, in said vending machine, during normal operation and/or during service mode operation.

10. The apparatus according to claim 1, wherein said software application programming interface (API) library is implemented without replacing said vending machine controller board in said vending machine, said vending machine controller board controls and/or monitors said vending machine, but said vending machine controller board is controlled and/or monitored by said software application programming interface (API) library.

11. The apparatus according to claim 1, wherein said software application programming interface (API) library is implemented without changing a said vending software program in said vending machine, said vending software program controls and/or monitors said vending machine, but said vending software program is controlled and/or monitored by said software application programming interface (API) library.

12. The apparatus according to claim 1, wherein said software application programming interface (API) library comprises one or more of the following functionality: 1) read and/or write said status information in said vending machine; 2) control and/or monitor said status information in said vending machine; 3) read and/or write said configuration data in said vending machine; 4) control and/or monitor said configuration data in said vending machine; 5) read and/or write a status and/or a configuration of said one or more events in said vending-machine; 6) control and/or monitor said one or more events in said vending machine; 7) read and/or write a status and/or a configuration of said one or more activities in said vending machine; 8) control and/or monitor said one or more activities in said vending machine; 9) retrieve data from said vending machine; 10) send data to said vending machine; 11) update data in said vending machine; 12) retrieve data on said vending machine; 13) send data from said vending machine.

13. The apparatus according to claim 1, wherein said software application programming interface (API) library, has the same set of software API functions for different vending machine brands and/or types, even if said different vending machine brands and/or types have a different processor, and/or hardware architecture, and/or software architecture.

14. The apparatus according to claim 1, wherein said software application programming interface (API) library is implemented as a software library for a software environment running on said microprocessor (B) or said host computer, and/or said debug circuit, and/or said microcontroller (A), and wherein a software application is implemented for said software environment, said software application controls and/or monitors said vending machine using said software application programming interface (API) library.

15. The apparatus according to claim 1, wherein said software application programming interface (API) library is implemented in a browser environment running on said microprocessor (B) or said host computer, and/or said debug circuit, and/or said microcontroller (A), and wherein a software application is implemented as a browser application for said browser environment, said browser application controls and/or monitors said vending machine using said software application programming interface (API) library.

16. The apparatus according to claim 1, wherein said software application programming interface (API) library is used to develop a software application that integrates and/or uses the functionality of said vending machine with one or more hardware and/or software systems.

17. The apparatus according to claim 1, wherein said software application implements and/or uses a remote client-server architecture, said apparatus is used to control and/or monitor said vending machine remotely from a remote client-server software application.

18. The apparatus according to claim 1, wherein said software application programming interface (API) library is implemented on a hardware abstraction layer (HAL) for said vending machine, said hardware abstraction layer makes abstraction of the technical hardware and/or software details in said vending machine, said hardware abstraction layer controls and/or monitors said vending machine.

19. The apparatus according to claim 1, wherein said apparatus implements and/or uses a hardware abstraction layer (HAL) for said vending machine, said hardware abstraction layer makes abstraction of the technical hardware and/or software details in said vending machine, said hardware abstraction layer controls and/or monitors said vending machine, said hardware abstraction layer is implemented on said microprocessor (B) or said host computer, and/or said debug circuit, and/or said microcontroller (A).

20. The apparatus according to claim 19, wherein said hardware abstraction layer (HAL) is implemented for said vending machine, without replacing said vending machine controller board in said vending machine, said vending machine controller board controls and/or monitors said vending machine, but said vending machine controller board is controlled and/or monitored by said hardware abstraction layer.

21. The apparatus according to claim 19, wherein said hardware abstraction layer (HAL) is implemented for said vending machine, without changing said vending software program in said vending machine, said vending software program controls and/or monitors said vending machine, but said vending software program is controlled and/or monitored by said hardware abstraction layer.

22. The apparatus according to claim 1, wherein said debug circuit, is connected to said microcontroller (A), via an interface on said microcontroller (A), and/or via an interface between said microcontroller (A) and said vending machine controller board, and/or via an interface on said vending machine controller board.

23. The apparatus according to claim 22, wherein said interface on said microcontroller (A) comprises one or more pins of said microcontroller (A), and/or one or more pins of the microcontroller socket of said microcontroller (A).

24. The apparatus according to claim 22, wherein said interface between said microcontroller (A) and said vending machine controller board comprises one or more pins of said microcontroller (A), and/or one or more pins of the microcontroller socket of said microcontroller (A).

25. The apparatus according to claim 1, wherein said debug circuit uses debug features in said microcontroller (A) and/or a debug software program with debug features in said microcontroller (A), to control and/or monitor said vending machine.

26. The apparatus according to claim 25, wherein said debug features are used to control and/or monitor one or more registers, and/or one or more data memory locations, and/or one or more program memory locations, in said microcontroller (A).

27. The apparatus according to claim 1, wherein said debug circuit controls and/or monitors one or more microcontroller peripherals, and/or an interrupt controller, in said microcontroller (A), to control and/or monitor said vending machine, said debug circuit comprises one or more of the following functionality: 1) control and/or monitor one or more signals on one or more interfaces connected to said microcontroller (A); 2) control and/or monitor one or more signals between said microcontroller (A) and said vending machine controller board;

3) control and/or monitor one or more registers in said microcontroller (A);
4) control and/or monitor one or more data memory locations in said microcontroller (A);
5) control and/or monitor one or more program memory locations in said microcontroller (A);
6) control and/or monitor one or more interrupts in said microcontroller (A).

28. The apparatus according to claim 27, wherein said microcontroller peripherals comprise one or more of: 1) I/O port peripheral; 2) UART peripheral; 3) A/D peripheral; 4) D/A peripheral; 5) I2C peripheral, said debug circuit comprises one or more of the following functionality:

1) monitor a value of an I/O pin; 2) modify a value of an I/O pin; 3) monitor serial data; 4) modify serial data; 5) ingest serial data; 6) monitor an analog measured value; 7) modify an analog measured value;
8) monitor an analog produced value; 9) modify an analog produced value; 10) monitor I2C data;
11) modify I2C data; 12) ingest I2C data; 13) monitor an interrupt; 14) generate an interrupt.

29. The apparatus according to claim 1, wherein said debug circuit comprises a switch matrix circuit that is placed in between said microcontroller (A) and said vending machine controller board, to control and/or monitor said vending machine, said switch matrix circuit comprises one or more of the following functionality:

1) bypass one or more signals between said microcontroller (A) and said vending machine controller board;
2) intercept one or more signals between said microcontroller (A) and said vending machine controller board;
3) redirect one or more signals between said microcontroller (A) and said vending machine controller board;
4) redirect one or more of said bypassed signals to said microprocessor (B) or said host computer;
5) redirect one or more of said intercepted signals to said microprocessor (B) or said host computer, said microprocessor (B) or said host computer controls and/or monitors one or more of said bypassed signals, and/or one or more of said intercepted signals, and/or one or more of said redirected signals.

30. The apparatus according to claim 29, wherein said switch matrix circuit is placed in between one or more pins of said microcontroller (A) and one or more pins of the microcontroller socket of said microcontroller (A).

31. The apparatus according to claim 1, wherein said debug circuit takes the role of, or replaces, or tri-states said microcontroller (A), said apparatus controls and/or monitors said vending machine from said microprocessor (B) or said host computer, through said interface between said microcontroller (A) and said vending machine controller board, without using said microcontroller (A).

32. The apparatus according to claim 31, wherein said interface between said microcontroller (A) and said vending machine controller board, comprises one or more pins of said microcontroller (A) and one or more pins of the microcontroller socket of said microcontroller (A).

33. The apparatus according to claim 1, wherein said debug circuit controls and/or monitors one or more analog signals, said debug circuit uses one or more A/D converters to monitor said analog signals, and/or said debug circuit uses one or more D/A converters to control said analog signals, wherein said A/D converters comprise one or more of: 1) an A/D converter in said microcontroller (A); 2) an A/D converter connected to said microcontroller (A); 3) an A/D converter connected to said vending machine controller board; 4) an A/D converter connected to said microprocessor (B) or said host computer; 5) an A/D converter connected to said debug circuit; 6) an A/D converter in said debug circuit, and wherein said D/A converters comprise one or more of: 1) a D/A converter in said microcontroller (A); 2) a D/A converter connected to said microcontroller (A); 3) a D/A converter connected to said vending machine controller board; 4) a D/A converter connected to said microprocessor (B) or said host computer; 5) a D/A converted connected to said debug circuit; 6) a D/A converter in said debug circuit.

34. The apparatus according to claim 1, wherein said debug circuit takes the role of, or replaces, or tri-states said microcontroller (A), and emulates said microcontroller (A) with an emulated microcontroller (A), said apparatus controls and/or monitors said vending machine through said emulated microcontroller (A), said emulated microcontroller (A) is implemented using a field programmable gate array (FPGA), and/or other hardware and/or software equivalents, and/or special purpose hardware, and/or a dedicated processor.

35. The apparatus according to claim 34, wherein said emulated microcontroller (A) implements debug features in said emulated microcontroller (A).

36. The apparatus according to claim 34, wherein said emulated microcontroller (A) makes one or more microcontroller peripherals in said emulated microcontroller (A) observable and/or controllable, and/or makes an interrupt controller in said emulated microcontroller (A) observable and/or controllable.

37. The apparatus according to claim 1, wherein said debug circuit is implemented using a field programmable gate array (FPGA), and/or other hardware and/or software equivalents, and/or special purpose hardware, and/or a dedicated processor.

38. The apparatus according to claim 1, wherein said microprocessor (B) or said host computer is implemented using a field programmable gate array (FPGA), and/or other hardware and/or software equivalents, and/or special purpose hardware, and/or a dedicated processor.

39. The apparatus according to claim 1, wherein said apparatus is implemented using a field programmable gate array (FPGA), and/or other hardware and/or software equivalents, and/or special purpose hardware, and/or a dedicated processor.

40. The apparatus according to claim 1, wherein said microcontroller (A) is implemented using a field programmable gate array (FPGA), and/or other hardware and/or software equivalents, and/or special purpose hardware, and/or a dedicated processor.

41. A method to control and/or monitor a vending machine, said method comprising the steps of:

1) integrate and/or use the apparatus according to claim 1 with said vending machine;

2) use said apparatus to control and/or monitor said vending machine during normal operation and/or during service mode operation.

42. The method according to claim 41, said method further comprising the steps of:

1) integrate and/or use said apparatus without replacing said vending machine controller board in said vending machine;

2) said vending machine controller board controls and/or monitors said vending machine, but said vending machine controller board is controlled and/or monitored by said apparatus.

43. The method according to claim 41, said method further comprising the steps of:

1) integrate and/or use said apparatus without changing said vending software program in said vending machine;

2) said vending software program controls and/or monitors said vending machine, but said vending software program is controlled and/or monitored by said apparatus.

44. The method according to claim 41, said method further comprising the steps of:

1) implement and/or use one or more features on said microprocessor (B) or said host computer, and/or make one or more features available through said microprocessor (B) or said host computer;

2) use said apparatus to add said features to said vending machine.

45. The method according to claim 41, said method further comprising the steps of:

1) use one or more additional interfaces of and/or in said apparatus, and/or add one or more additional interfaces to said apparatus;

2) add said additional interfaces to said vending machine through said interface with said microcontroller (A);

3) use said apparatus to add said additional interfaces to said vending machine;

4) use said additional interfaces to connect one or more peripherals to said vending machine, and/or to interface with one or more hardware and/or software systems.

46. The method according to claim 41, said method further comprising the steps of:

1) implement and/or use said software application programming interface (API) library for said vending machine on said microprocessor (B) or said host computer, and/or said debug circuit, and/or said microcontroller (A), said software application programming interface (API) library controls and/or monitors said vending machine;

2) use a software application that is developed for said vending machine and that uses said software application programming interface (API) library, or use said software application programming interface (API) library to develop a software application for said vending machine;

3) use said software application to control and/or monitor said vending machine during normal operation and/or during service mode operation.

47. The method according to claim 41, said method further comprising the steps of:

1) implement and/or use a hardware abstraction layer for said vending machine on said microprocessor (B) or said host computer, and/or said debug circuit, and/or said microcontroller (A), said hardware abstraction layer makes abstraction of the technical hardware and/or software details in said vending machine;

2) implement and/or use said software application programming interface (API) library for said vending machine on said hardware abstraction layer, said software application programming interface (API) library controls and/or monitors said vending machine;

3) use a software application that is developed for said vending machine and that uses said software application programming interface (API) library, or use said software application programming interface (API) library to develop a software application for said vending machine;

4) use said software application to control and/or monitor said vending machine during normal operation and/or during service mode operation.

48. The method according to claim 41, said method further comprising the steps of:

1) said debug circuit is connected to said microcontroller (A) via an interface on said microcontroller (A), and/or via an interface between said microcontroller (A) and said vending machine controller board, and/or via an interface on said vending machine controller board.

49. The method according to claim 41, said method further comprising the steps of:

1) said debug circuit uses debug features in said microcontroller (A) and/or a debug software program with debug features in said microcontroller (A), to control and/or monitor said vending machine.

50. The method according to claim 41, said method further comprising the steps of:

1) said debug circuit controls and/or monitors one or more microcontroller peripherals, and/or an interrupt controller, in said microcontroller (A), to control and/or monitor said vending machine.

51. The method according to claim 41, said method further comprising the steps of:

1) said debug circuit comprises a switch matrix circuit that is placed in between said microcontroller (A) and said vending machine controller board, to control and/or monitor said vending machine.

52. The method according to claim 41, said method further comprising the steps of:

1) said debug circuit takes the role of, or replaces, or tri-states said microcontroller (A), said apparatus controls and/or monitors said vending machine from said microprocessor (B) or said host computer, through said interface between said microcontroller (A) and said vending machine controller board, without using said microcontroller (A).

53. The method according to claim 41, said method further comprising the steps of:

1) said debug circuit controls and/or monitors one or more analog signals, said debug circuit uses one or more A/D converters to monitor said analog signals, and/or said debug circuit uses one or more D/A converters to control said analog signals.

54. The method according to claim 41, said method further comprising the steps of:

1) said debug circuit takes the role of, or replaces, or tri-states said microcontroller (A), and emulates said microcontroller (A) with an emulated microcontroller (A), said apparatus controls and/or monitors said vending machine through said emulated microcontroller (A), said emulated microcontroller (A) is implemented using a field programmable gate array (FPGA), and/or other hardware and/or software equivalents, and/or special purpose hardware, and/or a dedicated processor.

55. The method according to claim 41, said method further comprising the steps of:

1) said debug circuit is implemented using a field programmable gate array (FPGA), and/or other hardware and/or software equivalents, and/or special purpose hardware, and/or a dedicated processor.

56. The method according to claim 41, said method further comprising the steps of:

1) said microprocessor (B) or said host computer is implemented using a field programmable gate array (FPGA), and/or other hardware and/or software equivalents, and/or special purpose hardware, and/or a dedicated processor.

57. The method according to claim 41, said method further comprising the steps of:

1) said apparatus is implemented using a field programmable gate array (FPGA), and/or other hardware and/or software equivalents, and/or special purpose hardware, and/or a dedicated processor.

58. The method according to claim 41, said method further comprising the steps of:

1) said microcontroller (A) is implemented using a field programmable gate array (FPGA), and/or other hardware and/or software equivalents, and/or special purpose hardware, and/or a dedicated processor.

59. A vending machine, said vending machine comprising the apparatus according to claim 1, wherein said apparatus controls and/or monitors said vending machine during normal operation and/or during service mode operation.

60. A vending machine, said vending machine is controlled and/or monitored by the apparatus according to claim 1, whereby said vending machine comprises the debug circuit of the apparatus according to claim 1, whereby said apparatus does not comprise said debug circuit, said apparatus controls and/or monitors said vending machine during normal operation and/or during service mode operation.

* * * * *